US010427902B2

(12) United States Patent
Mellin et al.

(10) Patent No.: US 10,427,902 B2
(45) **Date of Patent: *Oct. 1, 2019**

(54) ENHANCED INTRODUCTORY PORTION FOR A SURFACE WINDER

(71) Applicant: The Procter & Gamble Company, Cincinnati, OH (US)

(72) Inventors: Gustav André Mellin, Amberley Village, OH (US); Bobby Randall Spence, Leesburg, GA (US)

(73) Assignee: The Procter & Gamble Company, Cincinnati, OH (US)

( * ) Notice: Subject to any disclaimer, the term of this patent is extended or adjusted under 35 U.S.C. 154(b) by 236 days.

This patent is subject to a terminal disclaimer.

(21) Appl. No.: 15/439,295

(22) Filed: Feb. 22, 2017

(65) Prior Publication Data

US 2017/0253449 A1 Sep. 7, 2017

Related U.S. Application Data

(60) Provisional application No. 62/303,473, filed on Mar. 4, 2016.

(51) Int. Cl.
*B65H 19/22* (2006.01)
*B65H 19/28* (2006.01)

(52) U.S. Cl.
CPC ..... *B65H 19/2269* (2013.01); *B65H 19/283* (2013.01); *B65H 2301/4181* (2013.01);
(Continued)

(58) Field of Classification Search
CPC .. B65H 19/305; B65H 19/2269; B65H 23/24; B65H 23/26; B65H 20/14
See application file for complete search history.

(56) References Cited

U.S. PATENT DOCUMENTS 1,421,730 A 7/1922 Lino Scusa
1,628,322 A 5/1927 Nicholas
(Continued)

FOREIGN PATENT DOCUMENTS

CN 2425067 Y 3/2001
CN 2575068 Y 9/2003
(Continued)

OTHER PUBLICATIONS

Grosskreutz, Martin, Continuous roll change in off-line calenders, Source: 88th Annual Meeting—Technical Section, Canadian Pulp and Paper Association, Preprints, vol. B, pp. B87-B91 (2002).
(Continued)

*Primary Examiner* — William A. Rivera
(74) *Attorney, Agent, or Firm* — Andrew J. Mueller

(57) ABSTRACT

An introductory portion for a surface winder is disclosed. The introductory portion comprises a surface. The surface has at least one channel disposed therein. The at least one channel has a single entry point and a single exit point and extends from a position external to the introductory portion and a first location disposed upon the surface. The first location is disposed upon the surface and is capable of receiving a fluid from the at least one channel. The fluid is fluidically displaced onto the core from the at least one channel when the core is in contacting engagement with the first location disposed upon the surface.

20 Claims, 17 Drawing Sheets

(52) U.S. Cl.
CPC ..... *B65H 2301/41424* (2013.01); *B65H 2408/235* (2013.01)

(56) References Cited

U.S. PATENT DOCUMENTS 1,870,225 A 8/1932 Berry
1,934,913 A 11/1933 Crisp
2,318,056 A 5/1943 Christman
2,493,590 A 1/1950 Mueller et al.
2,812,910 A 11/1957 Egan
2,877,959 A 3/1959 Charles Aaron et al.
2,913,098 A 11/1959 Zellinsky et al.
3,258,136 A 6/1966 Leonard et al.
3,290,861 A 12/1966 Prager
3,345,010 A 10/1967 Francis
3,494,566 A 2/1970 Pawelczyk
3,498,557 A 3/1970 Ball
3,516,620 A 6/1970 Lenten
3,539,127 A 11/1970 Grawey
3,610,545 A 10/1971 Reifenhauser et al.
3,630,462 A 12/1971 Nordgren et al.
3,680,804 A 8/1972 Aaron et al.
3,733,035 A 5/1973 Schott
3,791,602 A 2/1974 Isakson
3,869,046 A 3/1975 Gerhart
3,908,923 A 9/1975 Salgo
4,223,851 A 9/1980 Lewallyn
4,299,358 A 11/1981 Dropczynski et al.
4,327,877 A 5/1982 Perini
4,370,193 A 1/1983 Knauthe
4,408,727 A 10/1983 Dropczynski
4,422,588 A 12/1983 Nowisch
4,428,543 A 1/1984 Kuhn
4,485,979 A 12/1984 Dropczynski
4,487,377 A 12/1984 Perini
4,500,044 A 2/1985 Schnell
4,516,735 A 5/1985 Snygg
4,541,583 A 9/1985 Forman et al.
4,583,698 A 4/1986 Nistri et al.
4,609,162 A 9/1986 Kataoka
4,723,724 A 2/1988 Bradley
4,828,195 A 5/1989 Hertel et al.
4,856,752 A 8/1989 Linn
4,962,897 A 10/1990 Bradley
4,988,052 A 1/1991 Urban
5,104,055 A 4/1992 Buxton
5,104,155 A 4/1992 Kirkwood
5,137,225 A 8/1992 Biagiotti
5,222,679 A 6/1993 Dropczynski et al.
5,226,611 A 7/1993 Butterworth et al.
5,249,756 A 10/1993 Biagiotti
5,259,910 A 11/1993 Biagiotti
5,267,703 A 12/1993 Biagiotti
5,285,979 A 2/1994 Francesco
5,312,059 A 5/1994 Membrino
5,368,252 A 11/1994 Biagiotti
5,368,253 A 11/1994 Harley
5,370,335 A 12/1994 Vigneau
5,402,960 A 4/1995 Oliver et al.
5,421,536 A 6/1995 Hertel et al.
5,431,357 A 7/1995 Rueegg
5,478,027 A 12/1995 Alexander
5,505,405 A 4/1996 Vigneau
5,538,199 A 7/1996 Biagiotti
5,542,622 A 8/1996 Biagiotti
5,593,106 A 1/1997 Cavanagh
5,603,467 A 2/1997 Perini et al.
5,614,059 A 3/1997 Boriani et al.
5,641,356 A 6/1997 Delmore et al.
5,653,401 A 8/1997 Biagiotti et al.
5,690,296 A * 11/1997 Biagiotti ..... B65H 18/28 242/521
5,769,352 A * 6/1998 Biagiotti ..... B65H 19/2269 242/521
5,772,149 A 6/1998 Butterworth
5,779,180 A 7/1998 Smedt et al.
5,820,064 A 10/1998 Butterworth
5,839,680 A 11/1998 Biagiotti
5,845,867 A 12/1998 Hould et al.
5,853,140 A 12/1998 Biagiotti
5,875,989 A 3/1999 Alexander
5,909,856 A 6/1999 Myer et al.
5,979,818 A 11/1999 Biagiotti et al.
6,000,657 A 12/1999 Butterworth
6,056,229 A 5/2000 Daul et al.
6,129,304 A 10/2000 Biagiotti
6,145,777 A 11/2000 Zach et al.
6,155,515 A 12/2000 Doerfel et al.
6,286,419 B1 9/2001 Wallace
6,422,501 B1 7/2002 Hertel et al.
6,494,398 B1 12/2002 De Matteis et al.
6,517,024 B1 2/2003 Gambini
6,565,033 B1 5/2003 Biagiotti
6,595,458 B1 7/2003 Biagiotti
6,595,459 B2 7/2003 Hanson
6,629,662 B2 10/2003 Howden et al.
6,655,629 B1 12/2003 Acciari
6,659,387 B2 12/2003 Biagioni et al.
6,676,063 B2 1/2004 Gambini
6,698,681 B1 3/2004 Guy et al.
6,715,709 B2 4/2004 Stephens et al.
6,729,572 B2 5/2004 Baggot et al.
6,752,344 B1 6/2004 Biagiotti
6,752,345 B2 6/2004 Betti et al.
6,866,220 B2 3/2005 Sosalla et al.
6,877,689 B2 4/2005 Butterworth
6,926,224 B2 8/2005 Foehr et al.
6,945,491 B2 9/2005 Gambini
6,948,677 B2 9/2005 Biagiotti
6,966,521 B2 11/2005 White
7,175,126 B2 2/2007 Perini
7,175,127 B2 2/2007 Butterworth et al.
7,222,813 B2 5/2007 Tsai
7,318,562 B2 1/2008 Biagiotti et al.
7,338,005 B2 3/2008 Biagiotti et al.
7,350,739 B2 4/2008 Maddaleni et al.
7,398,942 B2 7/2008 Benvenuti et al.
7,404,529 B2 7/2008 Biagiotti et al.
7,469,856 B1 12/2008 Tsai
7,494,086 B2 2/2009 Tsai
7,523,884 B2 4/2009 Gelli et al.
7,775,476 B2 8/2010 Recami et al.
7,802,748 B2 9/2010 De Matteis et al.
7,832,676 B2 11/2010 Gelli
7,887,003 B2 2/2011 Maddaleni et al.
7,891,598 B2 2/2011 Maddaleni et al.
7,896,284 B2 3/2011 Morelli et al.
7,931,226 B2 4/2011 Benvenuti et al.
7,947,153 B2 5/2011 Tsai
8,011,612 B2 9/2011 Gelli et al.
8,181,897 B2 5/2012 Tsai
8,186,612 B2 5/2012 Gelli et al.
8,210,462 B2 7/2012 Wojcik et al.
8,215,086 B2 7/2012 Maddaleni et al.
8,267,344 B2 9/2012 Maddaleni et al.
8,282,032 B2 10/2012 Tsai
8,302,900 B2 11/2012 Gambini
8,424,481 B2 4/2013 Tsai
8,459,587 B2 6/2013 Wojcik et al.
8,807,066 B2 8/2014 Räikkönen
8,882,020 B2 11/2014 Lupi et al.
8,979,013 B2 3/2015 Gambini
9,365,379 B2 6/2016 Mazzaccherini et al.
9,586,779 B2 3/2017 Lupi et al.
9,604,810 B2 3/2017 Jendroska et al.
2003/0001042 A1 1/2003 Betti et al.
2005/0173585 A1 8/2005 Casella
2008/0111017 A1 5/2008 Gambini
2008/0223975 A1 9/2008 Planeta et al.
2008/0272223 A1 11/2008 Gambini
2009/0026299 A1 1/2009 Tsai
2009/0095836 A1* 4/2009 Maddaleni ..... B65H 19/2269 242/526
2009/0302146 A1 12/2009 Morelli et al.

(56) References Cited

U.S. PATENT DOCUMENTS

| | | | | |
|---|---|---|---|---|
| 2010/0133312 | A1* | 6/2010 | Tsai | B65H 19/2269 226/1 |
| 2010/0163665 | A1 | 7/2010 | Gambini | |
| 2010/0163666 | A1 | 7/2010 | Gambini | |
| 2010/0237179 | A1 | 9/2010 | De Matteis | |
| 2011/0133015 | A1 | 6/2011 | Gelli et al. | |
| 2012/0048985 | A1 | 3/2012 | Gambini | |
| 2013/0008995 | A1 | 1/2013 | Langella | |
| 2013/0020427 | A1 | 1/2013 | Gelli et al. | |
| 2013/0221150 | A1 | 8/2013 | Morelli et al. | |
| 2013/0284849 | A1 | 10/2013 | Mazzaccherini et al. | |
| 2014/0209730 | A1 | 7/2014 | Tanaka | |
| 2016/0001997 | A1 | 1/2016 | Maddaleni et al. | |
| 2017/0253448 | A1* | 9/2017 | Mellin | A47K 10/16 |
| 2017/0253449 | A1* | 9/2017 | Mellin | B65H 19/2269 |
| 2017/0253450 | A1* | 9/2017 | Mellin | A47K 10/16 |

FOREIGN PATENT DOCUMENTS

| | | | |
|---|---|---|---|
| CN | 101983907 | A | 3/2011 |
| CN | 201857145 | U | 6/2011 |
| CN | 101891076 | B | 5/2013 |
| DE | 1228223 | B | 11/1966 |
| DE | 2721883 | A1 | 11/1978 |
| DE | 2825154 | A1 | 12/1979 |
| DE | 3151256 | A1 | 10/1982 |
| DE | 3225518 | A1 | 3/1983 |
| DE | 8322778 | U1 | 11/1985 |
| DE | 8804614 | U1 | 5/1988 |
| DE | 8806890 | U1 | 7/1988 |
| DE | 9108164 | U1 | 9/1991 |
| DE | 4042169 | A1 | 7/1992 |
| DE | 4304469 | A1 | 8/1994 |
| DE | 29610198 | U1 | 10/1997 |
| DE | 29613556 | U1 | 12/1997 |
| DE | 19630923 | A1 | 2/1998 |
| DE | 102004000040 | A1 | 5/2006 |
| EP | 0078493 | A1 | 5/1983 |
| EP | 0118384 | A1 | 9/1984 |
| EP | 0514226 | A1 | 11/1992 |
| EP | 498039 | B1 | 12/1994 |
| EP | 0638500 | B1 | 5/1997 |
| EP | 0738231 | B1 | 1/1998 |
| EP | 968946 | B1 | 3/2003 |
| EP | 2436630 | A2 | 4/2012 |
| EP | 1982939 | B1 | 7/2013 |
| EP | 2669224 | A1 | 12/2013 |
| EP | 2676906 | A1 | 12/2013 |
| EP | 2669223 | B1 | 5/2014 |
| FI | 119763 | B | 3/2009 |
| FR | 1407836 | A | 8/1965 |
| GB | 259632 | A | 10/1926 |
| GB | 322400 | A | 12/1929 |
| GB | 666317 | A | 2/1952 |
| GB | 779662 | A | 7/1957 |
| GB | 796119 | A | 6/1958 |
| GB | 808758 | A | 2/1959 |
| GB | 856037 | A | 12/1960 |
| GB | 886774 | A | 1/1962 |
| GB | 944996 | A | 12/1963 |
| GB | 1065128 | A | 4/1967 |
| GB | 1071925 | A | 6/1967 |
| GB | 1094954 | A | 12/1967 |
| GB | 1179146 | | 1/1970 |
| GB | 1190850 | A | 5/1970 |
| GB | 1224569 | A | 3/1971 |
| GB | 1281473 | A | 7/1972 |
| GB | 1282387 | A | 7/1972 |
| GB | 1324183 | A | 7/1973 |
| GB | 1435525 | A | 5/1976 |
| GB | 1557038 | A | 12/1979 |
| JP | S57117446 | A | 7/1982 |
| JP | S57156944 | A | 9/1982 |
| JP | S5863644 | A | 4/1983 |
| JP | 58074446 | A | 5/1983 |
| JP | S58152750 | A | 9/1983 |
| JP | S58216854 | A | 12/1983 |
| JP | S6052449 | A | 3/1985 |
| JP | S60118562 | A | 6/1985 |
| JP | 2000218208 | A | 8/2000 |
| JP | 2001247237 | | 9/2001 |
| JP | 2008037511 | A | 2/2008 |
| NL | 192874 | B | 12/1997 |
| SE | 533751 | C2 | 12/2010 |
| SU | 296842 | A1 | 1/1971 |
| SU | 874553 | A1 | 10/1981 |
| SU | 925823 | A1 | 5/1982 |
| WO | WO9510472 | A1 | 4/1995 |
| WO | WO 9708088 | A1 | 3/1997 |
| WO | WO2004106201 | A1 | 12/2004 |
| WO | WO201004521 | A1 | 1/2010 |
| WO | WO201004522 | A | 3/2010 |
| WO | WO2010133037 | A1 | 11/2010 |
| WO | WO2011117827 | A1 | 9/2011 |

OTHER PUBLICATIONS

Jones, Greg, Winding area danger reduced, Pulp and Paper Europe, vol. 7, No. 6, p. 28 (May/Jun. 2002).
Johannsson, K., Winders—Automatic Supply of Machine Width Mandres, Revue A.T.I.P., vol. 38; Issue 4; pp. 185-187 (Apr. 1984).
PCT International Search Report, dated Jul. 6, 2017, 163 pages.
U.S. Appl. No. 15/438,061, filed Feb. 21, 2017, Mellin, et al.
U.S. Appl. No. 15/438,010, filed Feb. 21, 2017, Mellin.

* cited by examiner

ENHANCED INTRODUCTORY PORTION FOR A SURFACE WINDER

FIELD OF THE INVENTION

The present disclosure relates to an apparatus for the production of convolutely wound rolls of web material. The present disclosure more particularly relates to a rewinding machine for the production of rolls of convolutely wound web material, for example convolutely wound rolls of bath tissue and paper toweling, so as to obtain small rolls of bath tissue paper, all-purpose drying paper, and the like.

BACKGROUND OF THE INVENTION

Paper is normally produced by continuous machines which, through the delivery of a stock of cellulose fibers and water distributed from headboxes, generate a ply of cellulose material on a forming fabric, which ply is dried and wound in reels of large diameter. These reels are subsequently unwound and rewound to form logs of smaller diameter. The logs are subsequently divided into rolls of dimensions equal to the dimension of the end product. With this technique, rolls of toilet paper, kitchen towels or other tissue paper products are normally manufactured.

Rewinding machines are used to produce convolutely wound rolls or "logs" of web material. Rewinders are used to convert large parent rolls of paper into retail sized rolls and bathroom tissue and paper towels. These rewinding machines typically wind a predetermined length of web material about a tubular winding core normally made of cardboard. These rolls or logs are then cut into a plurality of smaller-size rolls intended for commercial sale and consumer use. The tubular winding core section remains inside each convolutely wound roll of web material. In both cases the end product contains a tubular core made of material different from that forming the roll.

One type of rewinding machine, known as a surface rewinding machine (or surface winder), the rotational movement of the tubular core on which the roll or log is formed is provided by peripheral members in the form of rollers or rotating cylinders and/or belts with which the roll or log is kept in contact during formation. Exemplary surface winders are disclosed in U.S. Pat. Nos. 3,630,462; 3,791,602; 4,541,583; 4,723,724; 4,828,195; 4,856,752; 4,909,452; 4,962,897; 5,104,155; 5,137,225; 5,226,611; 5,267,703; 5,285,979; 5,312,059; 5,368,252; 5,370,335; 5,402,960; 5,431,357; 5,505,405; 5,538,199; 5,542,622; 5,603,467; 5,769,352; 5,772,149; 5,779,180; 5,839,680; 5,845,867; 5,909,856; 5,979,818; 6,000,657; 6,056,229; 6,565,033; 6,595,458; 6,595,459; 6,648,266; 6,659,387; 6,698,681; 6,715,709; 6,729,572; 6,752,344; 6,752,345; and 6,866,220; the following International applications also provide exemplary surface winders; International Publication Nos. 01/16008 A1; 02/055420 A1; 03/074398 A2; 99/02439; 99/42393; and EPO Patent Application No. 0514226 A1.

The surface winder is comprised of 3 principle winding rolls to perform the surface winding process. These rolls are the first winding roller (or upper winding roll (UWR)), the second winding roller (or lower winding roll (LWR)), and the third winding roller (or rider roll (RR)). The respective rolls are named due to where or how they contact a winding log. The UWR and LWR contact the winding log on the upper and lower portions respectively and the RR "rides" on the upper portion of the winding log as it increases in diameter as web material is wound thereabout. The winding log enters the surface winder and is adhesively attached to a web material to be wound thereabout in a region of compression disposed between the UWR and LWR. The winding log is initially rotated by the UWR in a region disposed between the UWR and a stationary core cradle and rotationally translates to a region disposed intermediate the rotating, but stationary, UWR and LWR (known as the winding nest region). The RR contacts the surface of the rotating winding log in the winding nest region and translates away from the UWR and LWR as web material continues to be convolutely wound about the winding log.

In an exemplary surface wind system, a web material is convolutely wound about a paperboard core of 1.5" to 1.7" diameter and of a length that corresponds to the width of the tissue parent roll which comes from the paper machine, usually in width from 65" to 155".

However useful, current surface winders do have limitations. For example, the core, prior to being inserted into the winding system, will typically have an adhesive disposed upon it. This adhesive is intended to contact the web material coming into the UWR and cause it to fixably attach to the core via the adhesive disposed thereupon. This attachment of the web material to the core via the core glue is sometimes referred to as core bonding.

The core having the adhesive disposed upon its surface is then transferred to the surface winding system. However, there are several degrees of freedom with such a system as the core glue is applied to the core, the core is transferred to the winding cradle and then a portion of the web material is then adhesively attached to the core. These numerous degrees of freedom provide a significant opportunity for misalignment, mis-attachment, mis-insertion, etc. of the web material to the adhesive-laden core with such a system.

For example, as shown in FIG. 1, when a core is inserted into the region between the UWR and the cradle prior to insertion into the winding nest area, the core must undergo a transformation where the core surface speed must be accelerated from zero (i.e., has no surface speed at the point of entry) to the surface speed of the UWR (i.e., UWR running speed). In other words, the surface speed of the core is accelerated from zero to the surface speed of the UWR while disposed within the region between the cradle and the UWR. However, it has been observed that several mechanics-related principles in this region of the re-winder act to retard this required surface speed acceleration.

First, the entry portion of the cradle positioned at a fixed point disposed orbitally about the UWR typically has a smooth surface. An exemplary entry point is shown in FIG. 2. The placement of core having zero surface speed into the entry point of the winding cradle and the ensuing contact with the web material in contact with the UWR causes the core to slip (i.e., not spin) against this initial portion of the winding cradle. This slippage is represented by the arrow labeled "S" in FIG. 3. This slippage is believed to cause the core to oblongly deform into an ellipsoid shape.

Second, the glue-laden core is targeted to contact the web material in contact with the UWR at a predetermined location. Typically the targeted location on the web is immediately adjacent a perforation. If this targeted attachment location changes, several unfavorable results can occur in the early stage formation of the wound material.

For example, if the web attachment point occurs at a point removed backwards from the region near the perforation (e.g., behind the perforation), any excess leading web material will 'fold-back' upon the core and overlap the region of actual attachment of the web material to the core. This causes a consumer undesirable and unattractively wound product.

If the web attachment point occurs at a point removed forwards from the region near the perforation (e.g., ahead of the perforation), the web material can fail to attach to the core. This can result in the deposition of the adhesive disposed upon the core material to contact the manufacturing equipment. Ultimately, this can result in a process shut-down. Not only will the web material need to be re-threaded though the converting equipment, but adhesive will also have to be removed from the surfaces of the rewinding equipment such as the winding cradle and UWR.

Finally, if the core slides through the initial portion of the winding cradle, the adhesive disposed upon the core can be deposited upon the surfaces of the re-winding equipment (e.g., the winding cradle and UWR). This is a significant manufacturing issue that can result in a process shut-down to remove adhesive from the surfaces of the rewinding equipment such as the winding cradle and UWR.

Thus, there is a clearly defined need to improve the correlation and placement of adhesive upon a core at a point that is closer to the point of insertion into the winding cradle to prevent the drawbacks observed by current surface winding equipment that meets current manufacturing financial and processing targets. This can provide a closer association of the position upon the core where the adhesive is disposed thereupon with the web material that is intended to be contacted thereto.

SUMMARY OF THE INVENTION

The present disclosure provides for an improvement to a surface winder for winding a web material around a core. The improvement comprises an introductory portion comprising a surface. The surface has at least one channel disposed therein. The at least one channel has a single entry point and a single exit point and extends from a position external to the introductory portion and a first location disposed upon the surface. The first location disposed upon the surface is capable of receiving a fluid from the at least one channel. The fluid is fluidically displaced onto the core from the at least one channel when the core is in contacting engagement with the first location disposed upon the surface.

The present disclosure also provides for an introductory portion for a surface winder. The introductory portion comprises a surface. The surface has at least one channel disposed therein. The at least one channel has a single entry point and a single exit point and extends from a position external to the introductory portion and a first location disposed upon the surface. The first location is disposed upon the surface and is capable of receiving a fluid from the at least one channel. The fluid is fluidically displaced onto the core from the at least one channel when the core is in contacting engagement with the first location disposed upon the surface.

DETAILED DESCRIPTION

Figure 1:
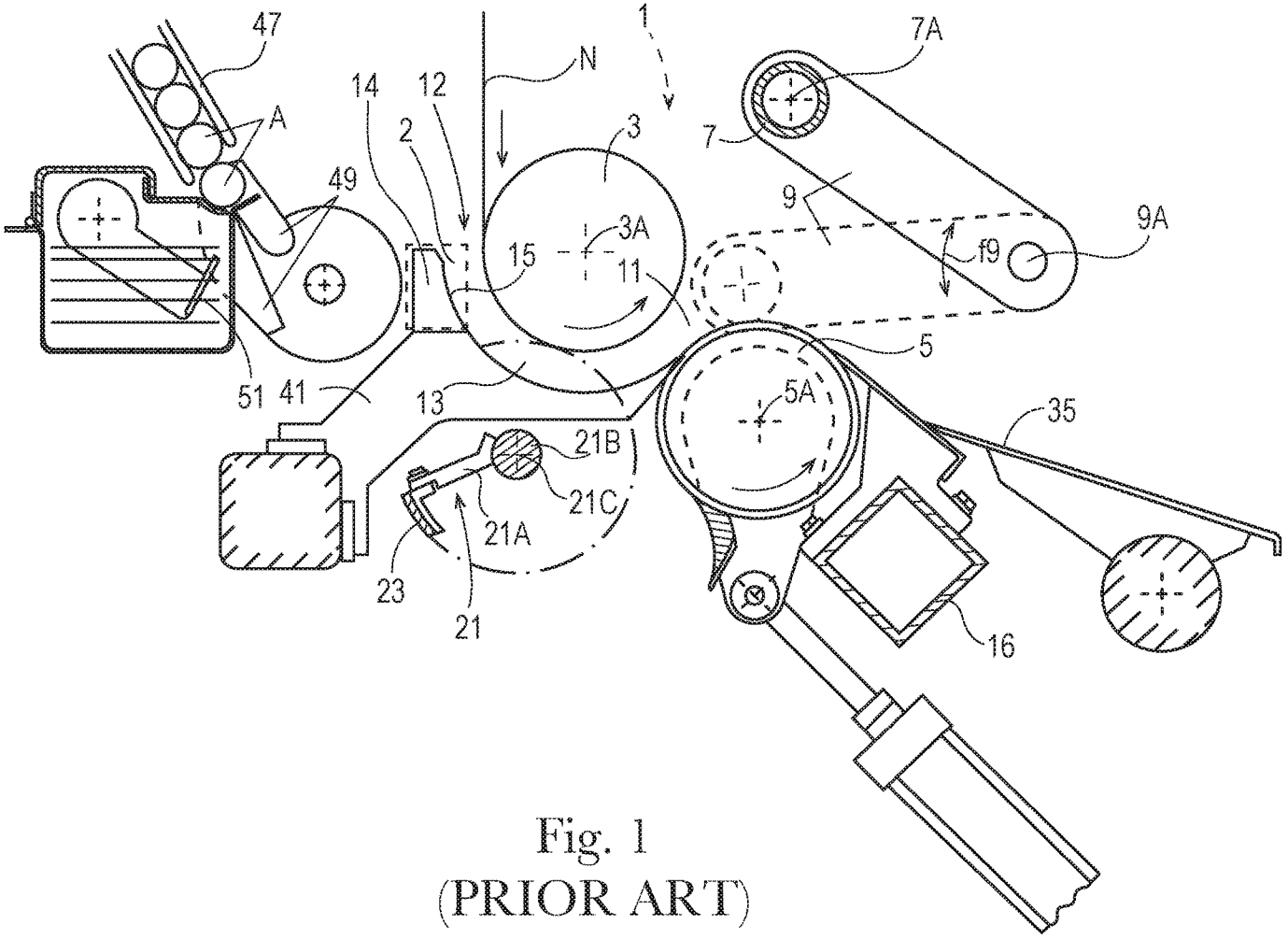
Fig. 1 (PRIOR ART)
FIG. 1 is a cross-sectional view of an exemplary surface rewinding machine.
Figure 2:
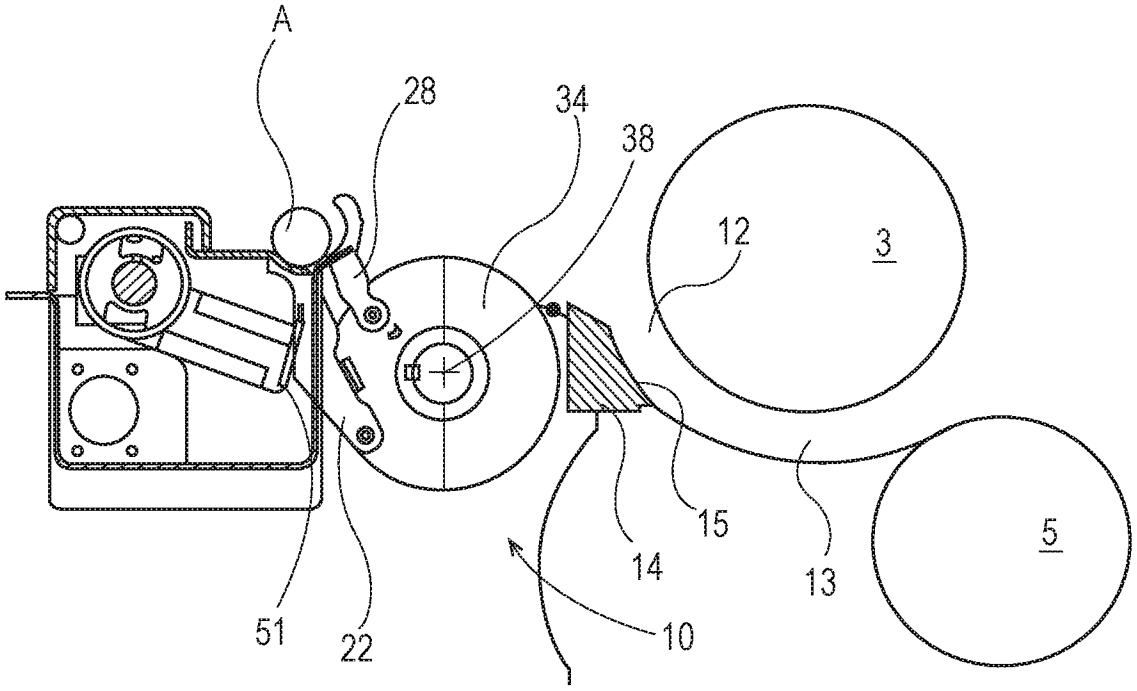
Fig. 2 (PRIOR ART)
FIG. 2 is a cross sectional view of an exemplary prior art surface winder including a core in-feed apparatus showing an initial stage of the transport of a winding core that has glue disposed upon a surface thereof.
Figure 3:
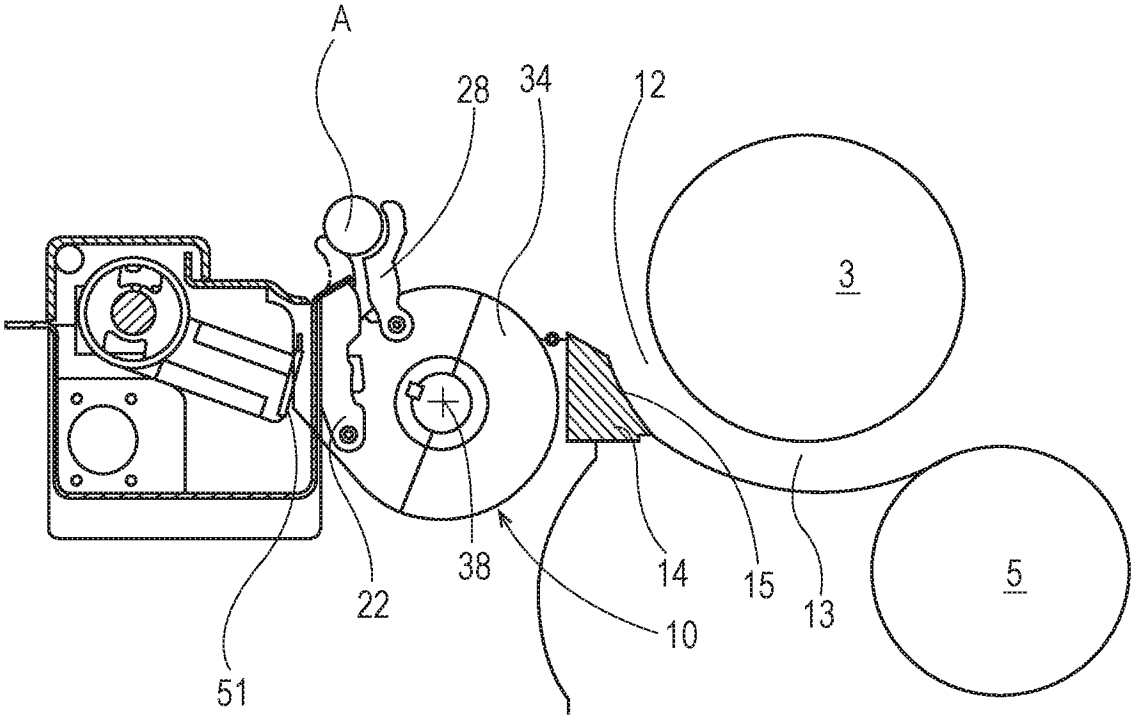
Fig. 3 (PRIOR ART)
FIG. 3 is a cross sectional view of an exemplary prior art surface winder including a core in-feed apparatus showing a second stage of the transport of a winding core that has glue disposed upon a surface thereof.
Figure 4:
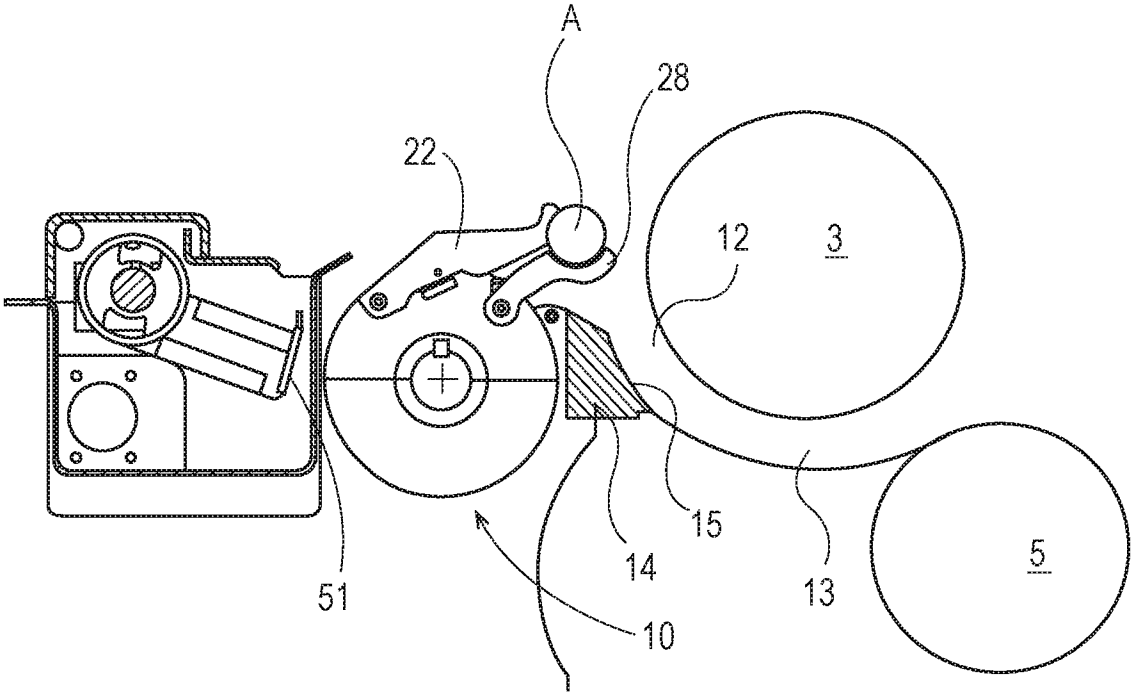
Fig. 4 (PRIOR ART)
FIG. 4 is a cross sectional view of an exemplary prior art surface winder including a core in-feed apparatus showing a third stage of the transport of a winding core that has glue disposed upon a surface thereof.
Figure 5:
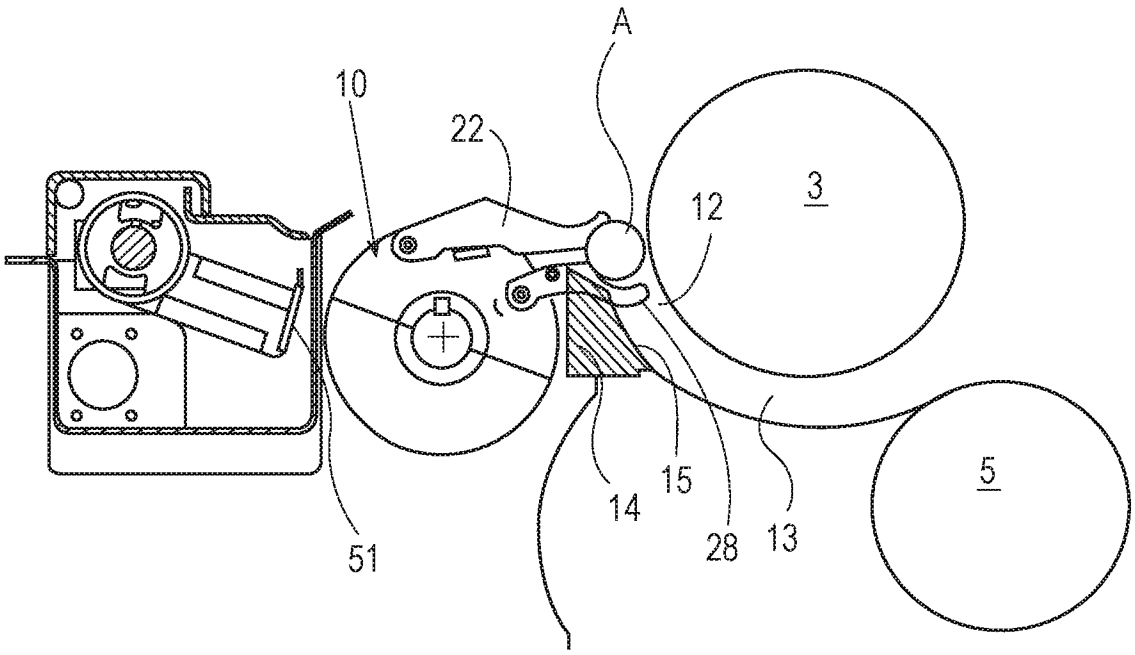
Fig. 5 (PRIOR ART)
FIG. 5 is a cross sectional view of an exemplary prior art surface winder including a core in-feed apparatus showing a fourth stage of the transport of a winding core that has glue disposed upon a surface thereof where the winding core is presented at the introductory portion of a winding cradle.
Figure 6:
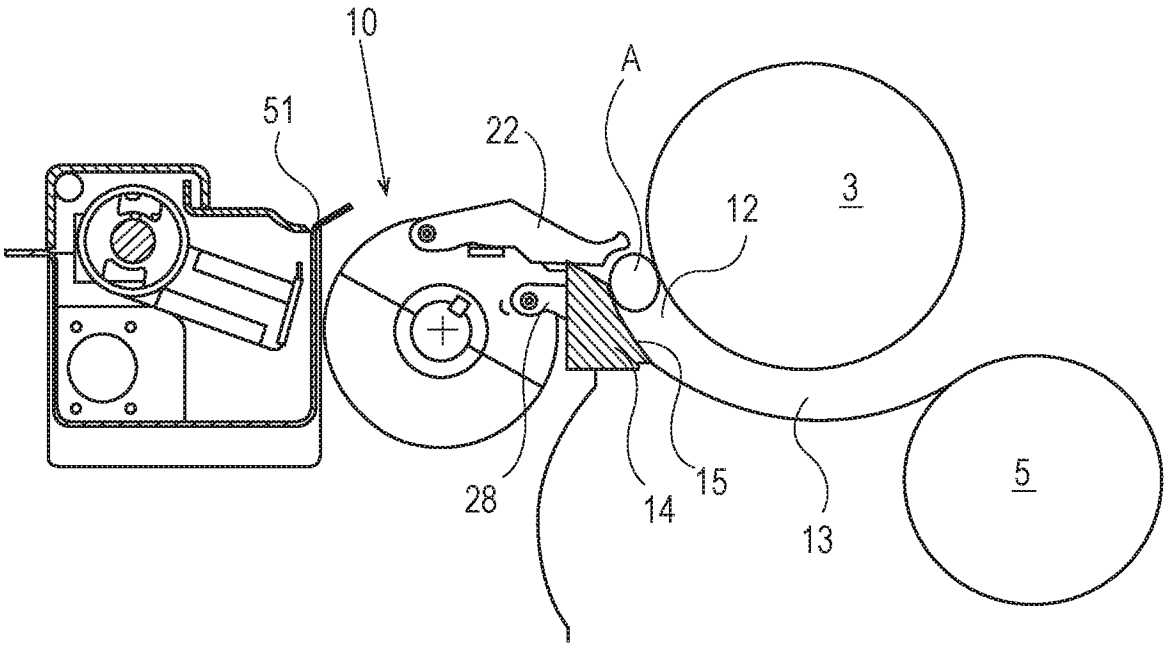
Fig. 6 (PRIOR ART)
FIG. 6 is a cross sectional view of an exemplary prior art surface winder having a winding core disposed at the introductory portion of a winding cradle.

An exemplary embodiment of a prior art surface winder (also referred to herein as rewinder) is shown in FIG. 1. As presented, FIG. 1 shows the main members of the rewinder, and in particular the members intended to feed the winding cores A and the winding rollers.

The winding head of the exemplary prior art rewinder is generally indicated with 1. In this exemplary embodiment, the winding head of the rewinding machine comprises a first winding roller 3 (also referred to herein as upper winding roll 3 or UWR 3) with a rotation axis 3A, a second winding roller 5 (also referred to herein as lower winding roll 5 or LWR 5) rotating about a rotation axis 5A and a third winding roller 7 (also referred to herein as rider roll 7 or RR 7) rotating about a third rotation axis 7A. A nip 11 is defined between the two winding rollers 3 and 5 for passage of the web material, having a speed, v, which can be equal to the surface speed of upper winding roll 3, to be convolutely wound about a winding core A (also referred to herein as core A).

In some embodiments the axis 3A of the first winding roller 3 is fixed with respect to a load bearing structure (not shown) of the rewinder 1. In other embodiments the axis 3A can be moving with respect to the load bearing structure (not shown).

In some embodiments the axis 5A of the second winding roller 5 is movable. In some embodiments the axis 5A can be moved to produce logs with a winding core A. In other embodiments, the rotation axis 5A of the second winding roller 5 can be movable in a controlled manner also during each winding cycle of logs upon a core A having a variable diameter. Ideally, the axis 5A of the second winding roller 5 can be movable to adapt the machine to winding cores A or mandrels having different diameters. In any regard, the first winding roller 3 can have a moving axis 3A for the same reasons indicated above. Further, both the winding rollers 3 and 5 can be movable and adjustable.

The third winding roller 7 is advantageously carried, for example, by a pair of arms 9 pivoting with a reciprocating movement according to the double arrow f9 about a pivoting axis 9A. The movement according to the double arrow f9 enables the third winding roller 7 to move toward or away from the first winding roller 3 and second winding roller 5 according to the diameter of the log L during the step of formation inside the winding cradle defined by the three winding rollers 3, 5 and 7.

The exemplary prior art rewinder 1 can be provided with a concave cradle 41. The concave cradle 41 can be preferably formed by a series of mutually parallel shaped plates (only one of which is visible in the drawing) and the others being superimposed thereon. The various shaped plates all have a concave edge forming a concave surface for rolling of the winding cores A.

As shown, the winding cores A are each fed along a feeder 47. Single winding cores A can be picked up by a core inserter 49 after a longitudinal line of glue has been applied thereto by a glue applicator 51. The machine in this arrangement has substantially the same structure and operation as that described in U.S. Pat. No. 5,979,818. Therefore the routine operating cycle will not be described in detail.

As shown in FIGS. 2-6, an exemplary cam housing 34 operable connected to core inserter 10 can be provided with a cam disposed within cam housing 34 that defines the orbital motion of a movable finger 28 attached thereto about the longitudinal axis of core inserter 10. The cam can be provided with any desired profile required by the manufacturing operation to provide the desired motion of the moveable finger 28 about the longitudinal axis 38.

In this regard, movable finger 28 can emanate from a centroid of cam housing 34 in a manner that causes cam housing 34 to orbit about the longitudinal axis 38 of cam-controlled core inserter 10. As cam housing 34 orbits about the longitudinal axis 38 while disposed in contacting and moveable engagement with cam housing 34, cam housing 34 can define the motion of the movable finger 28 relative to the longitudinal axis 38, fixed finger 22, and winding core A.

As shown in FIGS. 3-6, as the fixed fingers 22 of core inserter 10 approach the introductory portion 12 of winding cradle 13, winding core A remains in contacting engagement with fixed finger 22 and movable finger 28 of cam-controlled core inserter 10 as the winding core A approaches the introductory portion 12 of winding cradle 13.

Returning again to FIG. 1, the moving member 21 can be used to sever the web material N at a perforation disposed between adjacent portion of web material N, but winding starts on the winding core A. Generally, the member 21 does not perform any function in relation to this action, except for an optional effect of accompanying the leading edge toward the new winding core A that is inserted into the channel formed between the winding roller 3 and the cradle 41 upstream (with respect to the direction of feed of the web material N) of the moving member 21.

Interaction between the concave cradle 41 and the moving member 21 is permitted by the fact that the former has a comb shaped structure formed by a plurality of parallel plates. In this way, the pads 23 of the moving member 21 can pass between adjacent plates and position the winding core A within the feed channel of the winding cores A formed and disposed between the concave surface 41A of the cradle 41 and the cylindrical surface 3B of the winding roller 3.

The concave cradle 41 can be supported for rotation about the rotation axis 21C of the moving member 21. The moving member passes from an idle position to an operating position by pivoting about the rotation axis 21C. Pivoting motion can be provided and controlled by a piston-cylinder actuator.

Moving member 21 can be provided with a reciprocating oscillatory or rotary movement around it rotational axis. The moving member 21 preferably rotates in clockwise direction to come into contact with the web material N and pinch it against the cylindrical surface of the winding roller 3 and perform severing of the web material N at a perforation disposed between adjacent portions of web material N.

As mentioned previously, single winding cores A are picked up by a core inserter 49 after a longitudinal line of glue has been applied thereto by a glue applicator 51. The core inserter 49 translates the winding core A having glue disposed thereon to a point of entry into the introductory portion 12 of the surface rewinding machine disposed between the upper winding roll 3 having a web material N disposed about at least a portion thereof and the concave cradle 41. The region disposed between concave cradle 41 and upper winding roll 3 is referred to herein as winding cradle 13. The region disposed between leading edge device 14 and upper winding roll 3 forms the introductory portion 12 of winding cradle 13. While it is possible for web material N to have a velocity, v, that is different from the surface velocity of upper winding roll 3 about its longitudinal axis 3A, for purposes of discussion herein, it can be presumed that the velocity, v, of the web material N is the same as the surface velocity of upper winding roll 3 as upper winding roll 3 rotates about its longitudinal axis 3A.

Figure 7:
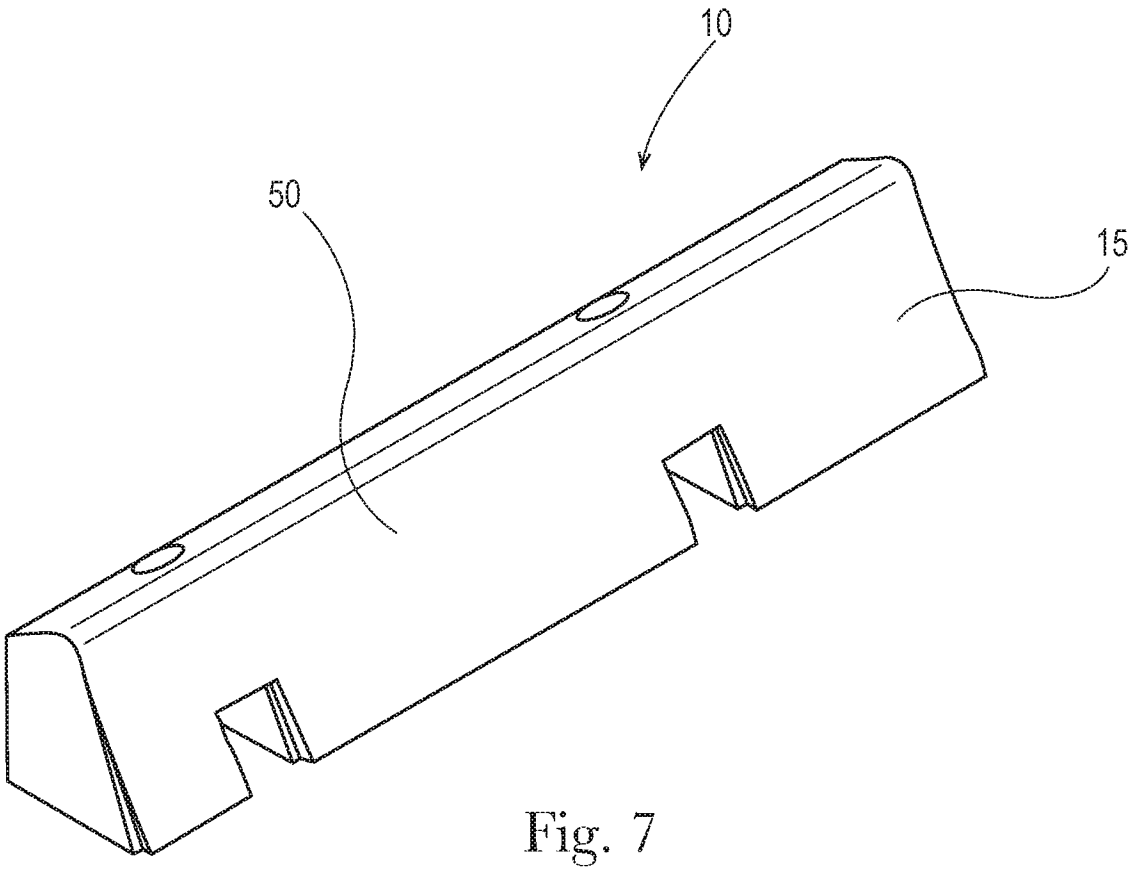
Fig. 7 (PRIOR ART)
FIG. 7 is a perspective view of an exemplary prior art introductory portion of the winding cradle of the region labeled 2 in FIG. 1 having a smooth surface.

As shown in FIG. 7, a typical prior art leading edge device 14 placed in contacting engagement with concave cradle 41 at the introductory portion 12 of winding cradle 13 is provided with a surface 15 that can be considered to have a finish texture 50 that provides a generally smooth and polished finish. Leading edge device 14 is typically affixed to the concave cradle 41.

Figure 8:
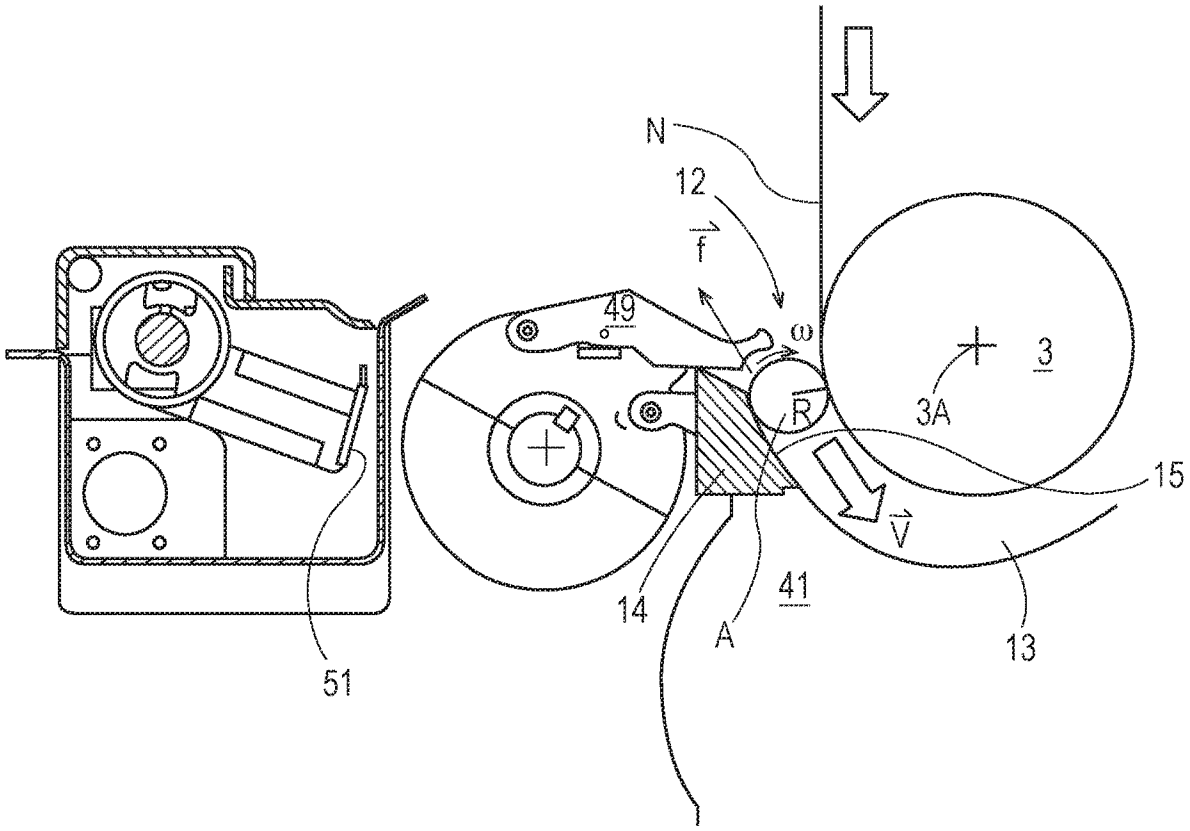
Fig. 8 (PRIOR ART)
FIG. 8 is a cross-sectional view of an exemplary surface prior art winding machine showing a core 'slipping' through the introductory portion of the surface rewinding machine while disposed between the upper winding roll and the winding cradle due to the introductory portion of the winding cradle of the region labeled 2 in FIG. 1 having a smooth surface.

As shown in FIG. 8 however, and as discussed supra, a leading edge device 14 that is provided with a generally smooth and polished finished surface can actually facilitate the sliding (i.e., translational) motion of a winding core A disposed within the introductory portion 12 of winding cradle 13. Without desiring to be bound by theory, it is believed that winding core A initially slips (i.e., has translational motion and little or no rotational motion about its axis), and does not immediately assume a rotational surface speed as it first contacts the surface 15 of leading edge device 14 and the moving web material N having a velocity, v, contacting the surface of upper winding roll 3. Since there is no rotational surface speed as winding core A first contacts surface 15 of leading edge device 14 and the moving web material N, any adhesive disposed upon the core A is now out of the desired and/or necessary rotational position for attachment to the moving web material N. For example, the glue-laden core A (targeted to contact the web material N in contact with the upper winding roll 3 at a predetermined location immediately adjacent a perforation) will not contact the web material N at the predetermined location disposed upon the surface of winding core A due to the lack of rotational motion and presence of translational motion while disposed within the introductory portion 12 disposed between the leading edge device 14 and the moving web material N. This can cause several unfavorable results that result in mal-formed final product.

For example, if the web material N attachment point to the winding core A occurs at a point removed backwards from the region near a perforation (e.g., behind the perforation) present in web material N, any excess leading web material N can 'fold-back' upon the winding core A and overlap the region of actual attachment of the web material N to the winding core A. This causes a consumer undesirable and unattractively wound product.

If the web material N attachment point to the core A occurs at a point removed forwards from the region near the perforation (e.g., ahead of the perforation) present in web material N, the web material N can fail to attach to the winding core A. This can result in the deposition of the adhesive disposed upon the core A upon the manufacturing equipment (e.g., the surface 15 of leading edge device 14, winding cradle 13, upper winding roller 3, and/or concave cradle 41). Ultimately, this can result in a process shut-down. Not only will the web material N need to be re-threaded though the rewinder 1, but adhesive will also have to be removed from the various surfaces of the rewinding equipment (e.g., the surface 15 of leading edge device 14, winding cradle 13, upper winding roller 3, and/or concave cradle 41).

If the winding core A slides through the initial portion of the winding cradle 13, the adhesive disposed upon the winding core A can be deposited upon the surfaces of rewinder 1. This is a significant manufacturing issue that can result in a process shut-down to remove adhesive from the surfaces of the rewinder 1 such as first winding roller 3, second winding roller 5, third winding roller 7, concave cradle 41, winding cradle 13, and/or leading edge device.

One of skill in the art will understand that when rolling of winding core A happens without slipping, the point of contact of winding core A has zero linear velocity relative to the surface 15 of leading edge device 14. When rolling with slipping occurs, the point of contact of winding core A with the surface 15 of leading edge device 14 has a non-zero linear velocity relative to the surface 15 of leading edge device 14. As the winding core A effectively slides along (or upon) the surface 15 of leading edge device 14, kinetic friction, f, eventually reduces the linear (e.g., non-rotational) velocity of winding core A relative to the surface 15 of leading edge device 14. This frictional, f, force also causes the winding core A to start rotating about its center of mass (cm). The linear velocity along the surface 15 of leading edge device 14 of winding core A decreases and the angular velocity, ω, of winding core A increases until the non-slip condition $v_{cm}=R\omega$ is met. Then winding core A rolls upon the surface 15 of leading edge device 14 about its center of mass without slipping.

In other words, the linear velocity, v, of the winding core A must always equal the rate of rotation, ω, of the winding core A multiplied by the radius, R, of the winding core A from the center of rotation to the point of contact of winding core A with upper winding roll 3. If the magnitude of the linear velocity at the edge of the rotating winding core A does not equal the magnitude of the linear velocity of the center of rotation of the rotating winding core A, then there must be slipping at the point of contact of winding core A with upper winding roll 3 or the surface 15 of leading edge device 14. This results in the linear, non-rotating (i.e., translational) movement of winding core A relative to the surface 15 of leading edge device 14 because the center of rotation/mass of the winding core A must move faster than the rotation of upper winding roll 3 can move it. The force of friction, f, from the surface 15 of leading edge device 14 is the only force acting upon the surface of winding core A to cause the winding core A to reduce its translational velocity, v, and increase the rotational velocity of winding core A to match the surface speed of upper winding roll 3 and web material N in contacting engagement therewith (e.g., in the rewinder 1 described herein—also having velocity, v).

Mathematically stated, at the point of insertion of the winding core A into the introductory portion 12 of winding cradle 13 exhibiting slipping and rolling (translational and rotational movement) forward provides $v_{cm}<R\omega$. Thus, the path of winding core A through the introductory portion 12 of winding cradle 13 forms a prolate (contracted) cycloid because the surface of the winding core A can be traced out points on the surface of the generating circle that is slipping while rolling with $v_{cm}<R\omega$.

To combat this artifact of current rewinder 1 systems, the present disclosure provides a unique introductory portion 12 of winding cradle 13 for insertion of the winding core A into the introductory portion 12 of winding cradle 13 of rewinder 1.

Figure 9:
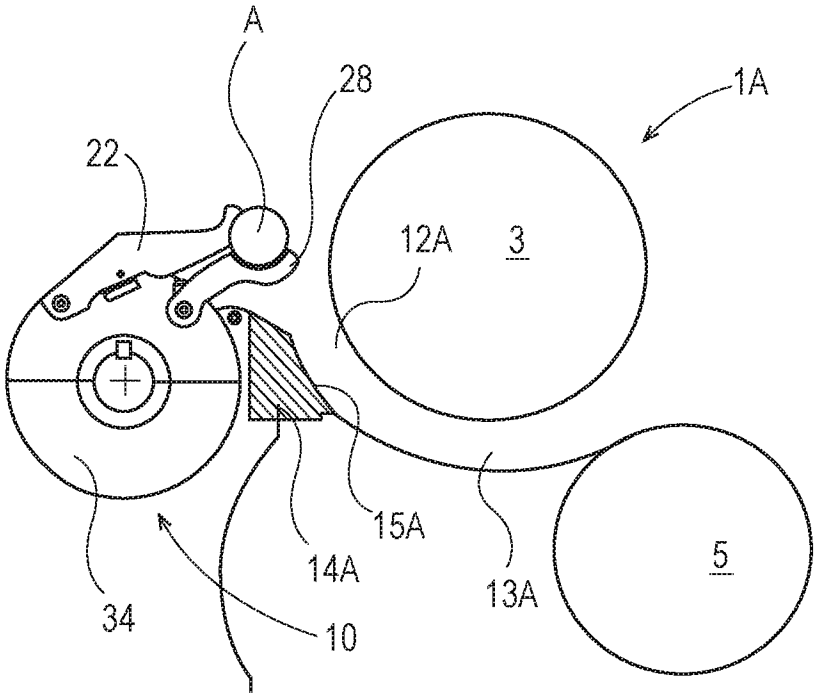
FIG. 9 is a cross-sectional view of an exemplary surface rewinding machine having an exemplary introductory portion provided in the present disclosure.

As shown in FIG. 9, the unique leading edge device 14A can be incorporated into the introductory portion 12A of winding cradle 13A and can also effectively eliminate the need for a rewinder 1A system to incorporate a glue applicator 51 as well as the associated storage capability/capacity for the storage of glue to be disposed upon a particular core A prior to insertion into the introductory portion 12A of winding cradle 13A. The unique leading edge device 14A incorporated into the introductory portion 12A of winding cradle 13A can also significantly and effectively reduce the hygiene issues related to the deposition of process and/or web material N dust within and/or upon any adhesive used to bond web material N to a winding core A. The unique leading edge device 14A incorporated into the introductory portion 12A of winding cradle 13A can also significantly and effectively reduce the uncertainty associated with the translational movement and insertion of a glue-laden winding core A into the introductory portion 12A of winding cradle 13A by an associated core insertion device and the attachment to the web material N by providing a closer (more proximal or direct) relationship between the point of glue deposition upon the winding core A and the associated attachment of the web material N thereupon.

As shown in FIGS. 10-13, leading edge device 14A can be provided with at least one pressure-sensitive valve 50 provided upon or recessed within surface 15A of leading edge device 14A. A source of glue or other fluid can be supplied to each pressure-sensitive valve 50 via a respective channel 52 disposed within leading edge device 14A so that glue or other fluid that is desired to be applied to the surface of a winding core A can be supplied from a glue or fluid source disposed external to leading edge device 14A and provided in fluid communication with pressure-sensitive valve 50 via channel 52 as discussed infra.

In operation, a core A is disposed at the introductory portion 12A of rewinder 1A upon the surface 15A of leading edge device 14A by core inserter 10. As core A progresses into eventual contacting engagement with upper winding roll 3 and/or web material N it concurrently progresses along surface 15A of leading edge device 14A in eventual rotating engagement with surface 15A of leading edge device 14A. As core A is rotationally transported across surface 15A of leading edge device 14A while in contacting engagement with web material N and/or upper winding roll 3, core A can assume contacting engagement with pressure sensitive valve 50.

As core A contactingly engages pressure-sensitive valve 50 and provides pressure to the pressure-sensitive valve 50, pressure-sensitive valve 50 opens allowing glue, adhesive, or any other fluid disposed within channel 52 to fluidly migrate past the surface of pressure-sensitive valve 50 and into contacting engagement with the surface of core A. Core A, now having glue or fluid disposed upon a surface thereof can then rotate into contacting engagement with web material N where web material N is then contactingly and releasably engaged with core A via the glue or fluid disposed upon the surface of the winding core A.

One of skill in the art will readily recognize that the deposition of glue or fluid upon core A while disposed within introductory portion 12A can facilitate the more accurate placement and/or attachment of the web material N at a portion of web material N that is disposed adjacent a CD-oriented perforation. This can reduce and even remedy the undesirable attributes associated with the placement of glue upon core A by an external process and translating the glue-laden core A from the glue application device to the introductory portion 12A as discussed supra. In other words, and by way of example only, a glue can be disposed upon the surface of a core A that is disposed in contacting engagement with both the surface 15A of leading edge device 14A and the web material N that is engaged with the surface of upper winding roll 3 of rewinder 1A that is in complete rotational and translational control while disposed within the introductory portion 12 between leading edge device 14A and upper winding roll 3. Thus the glue can be disposed upon a portion of the surface of core A and immediately rotate into a pre-determined and/or desired location disposed upon the surface of web material N. This pre-determined and/or desired location disposed upon the surface of web material N can be provided immediately adjacent a CD-oriented perforation disposed within web material N.

Figure 10:
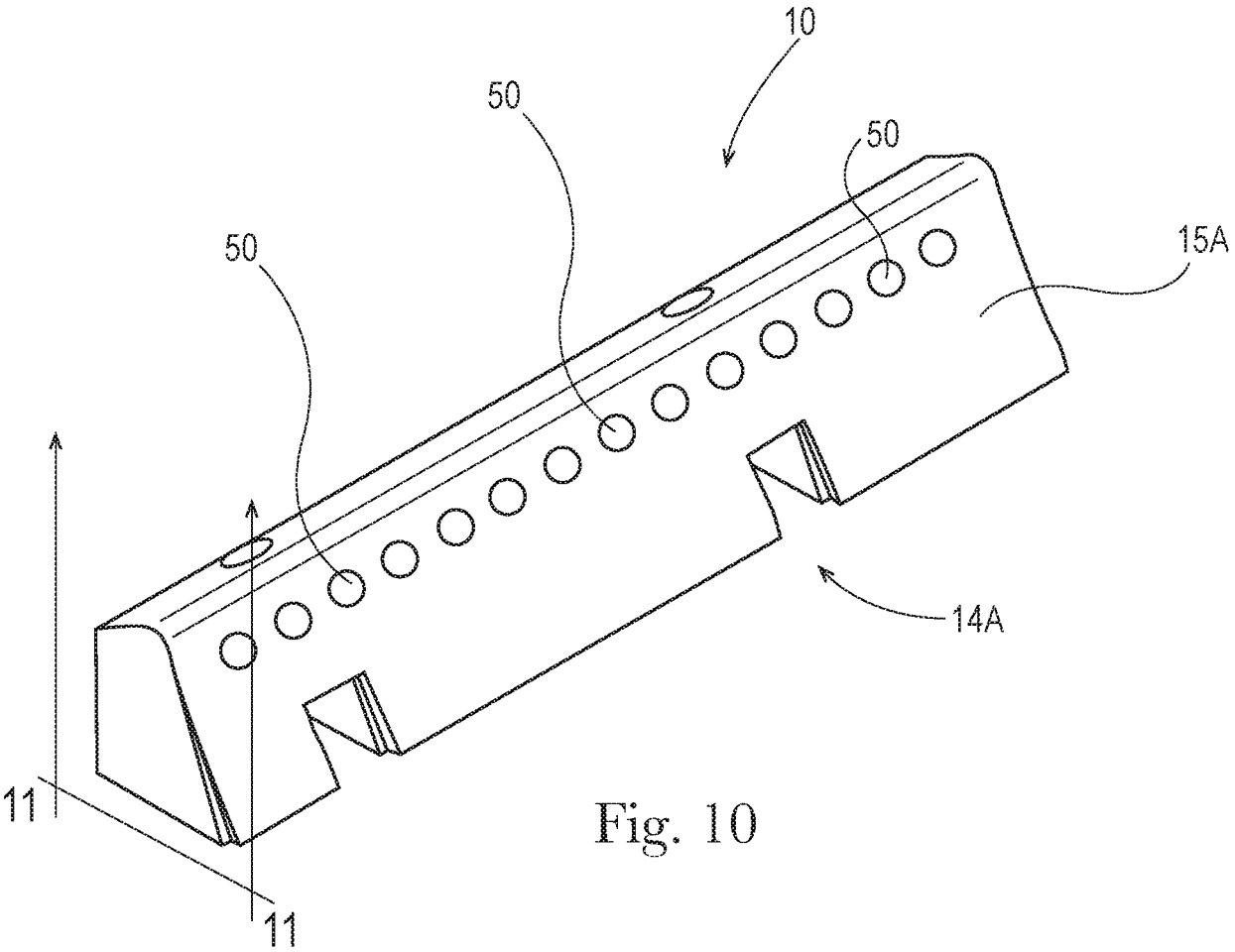
FIG. 10 is a perspective view of an exemplary introductory portion for a surface rewinding machine having exemplary pressure-sensitive valves disposed within the surface.
Figure 11:
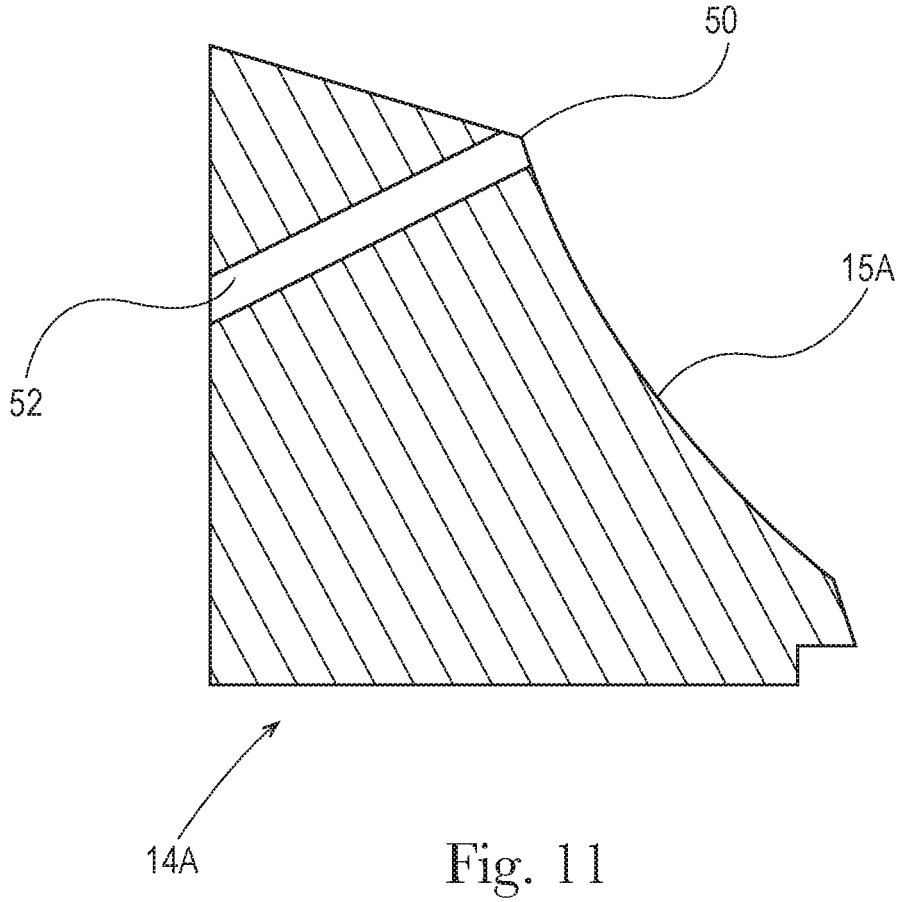
FIG. 11 is a cross-sectional view of the exemplary introductory portion of FIG. 10 taken at 10-10 showing an exemplary channel in fluid communication with an exemplary pressure-sensitive valve.
Figure 12:
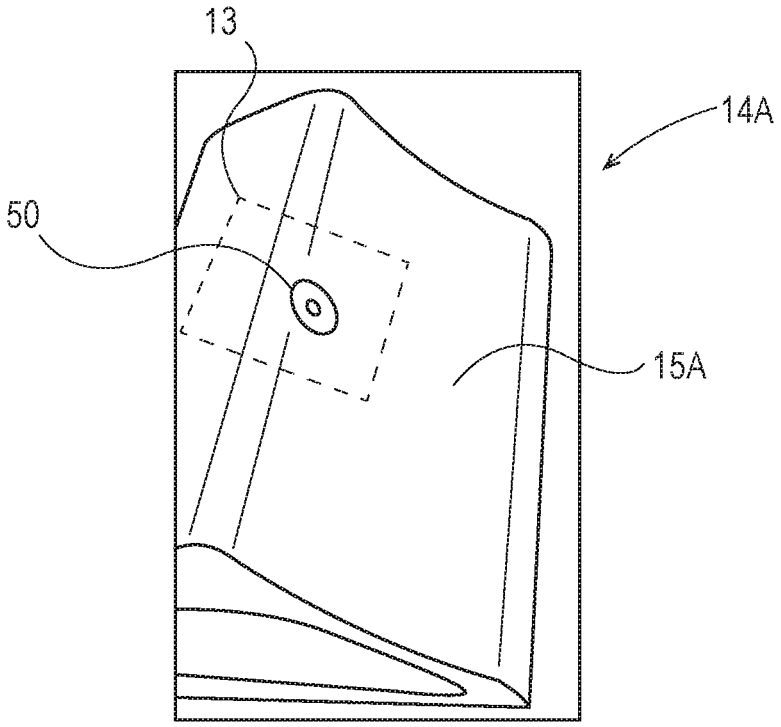
FIG. 12 is a photograph showing a perspective view of an exemplary introductory portion for a surface rewinding machine showing an exemplary pressure-sensitive valve disposed within the surface.
Figure 13:
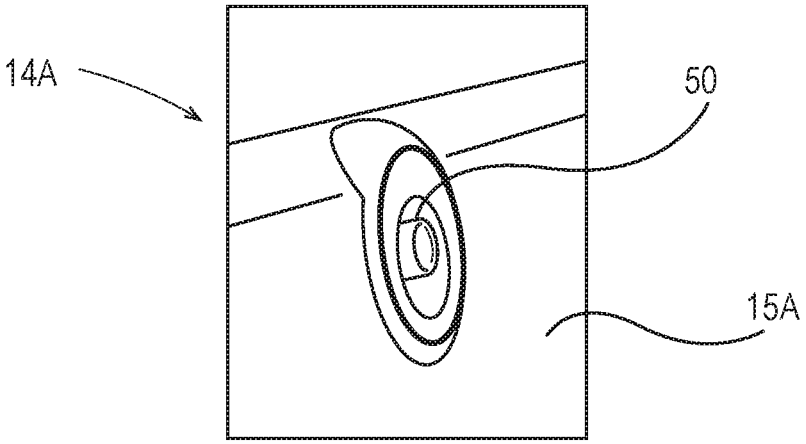
FIG. 13 is a photograph of the portion labeled 13 of the photograph of FIG. 12 showing a close-up view of an exemplary pressure-sensitive valve disposed within the surface.

A shown in FIG. 10, a plurality of pressure-sensitive valves 50 can be provided within or upon the 3 surface 15A of leading edge device 14A. The plurality of pressure-sensitive valves 50 can be provided with any desired positioning upon the surface 15A of leading edge device 14A. Any desired positioning can be provided in any desired configuration upon the surface 15A of leading edge device 14A to include sinusoidal, saw-tooth, square, collectively elongate, and/or combinations thereof. Thus, one of skill in the art would be able to provide glue upon the surface of core A in a manner that provides the most efficacious fastening of web material N upon core A via the glue disposed thereon. Each pressure-sensitive valve 50 can be supplied with glue, adhesive, or other fluid through an individual channel 52 associated with a respective pressure-sensitive valve 50 associated thereto. Alternatively, a plurality of pressure-sensitive valves 50 can be supplied with glue, adhesive, or other fluid through an individual channel 52 associated with the plurality pressure-sensitive valve 50 associated thereto through internal plumbing that would be recognized by one of skill in the art or through the connection of each respective pressure-sensitive valve 50 of a given plurality of pressure-sensitive valves 50 through a manifold that provides contacting engagement of a respective or plurality of channels 52 with the plurality of pressure-sensitive valves 50. Such plumbing architecture can be provided with methods known in the art as additive manufacturing and all of its industrially known equivalents.

While numerous pressure sensitive valves are available to those of skill in the art, a valve suitable as a pressure-sensitive valve 50 is available from Parker Valves, Klundert, NL.

One of skill in the art would understand that it can also be desirable to provide the winding core A with pure rolling motion at the point of contact with upper winding roll 3 and the surface 15 of leading edge device 14.

One of skill in the art would understand that it can be highly desirable to provide the winding core A with pure rolling motion at the point of contact with a glue, adhesive, or other fluid through an individual channel 52 associated with the plurality pressure-sensitive valve 50 immediately preceding a partial rotation of the surface of a winding core A into immediate contacting engagement with the upper winding roll 3 and the surface 15 of leading edge device 14.

In this way, the rolling of winding core A becomes a combination of both translational and rotational motion. In this way, when winding core A experiences pure translational motion, all of its points move with the same velocity as the center of mass (e.g., in the same direction and with the same speed ($v=v_{cm}$). Further, when the winding core A experiences pure rotational motion about its center of mass, all of its points move at right angles to the radius, R, in a plane perpendicular to the axis of rotation, so that points on opposite sides of the axis of rotation of winding core A move in opposite directions, move with a speed proportional to radius ($v=R\omega$), so that the center of mass does not move (since R=0) and points on the outer radius of winding core A move with speed $v=R\omega$, and move in a circle centered on the axis of rotation (also the center of mass).

An exemplary leading edge device 14 can be provided with a surface 15 that has a texture 50 provided thereto. Without desiring to be bound by theory, it is believed that providing a leading edge device 14 with a finish texture upon surface 15 that can reduce the slippage of a respective winding core A inserted into the introductory portion 12 of winding cradle 13.

Figure 14:
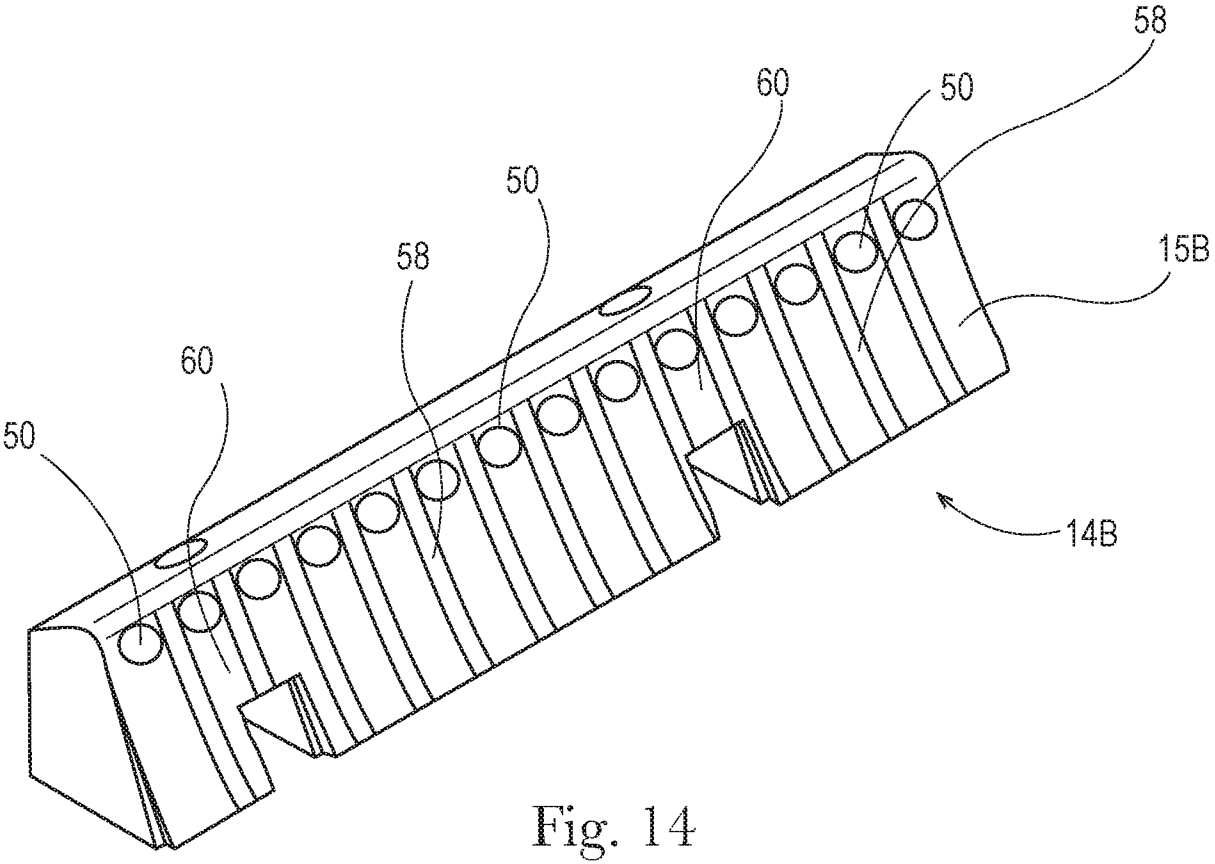
FIG. 14 is a perspective view of another exemplary introductory portion for a surface rewinding machine having both pressure-sensitive valves and disposed upon raised areas disposed upon the surface and recessed areas disposed within the surface thereof.

In the exemplary, but non-limiting, alternative embodiment shown in FIG. 14, the surface 15B of introductory portion 14B can be provided with a finish texture comprising a plurality of raised areas (or ridges) 58 and/or a plurality of recessed areas 60 relative to the surface 15B of introductory portion 14C that can assist in providing the winding core A with a pure rolling motion at the point of contact with upper winding roll 3 and the surface 15C of leading edge device 14C. As depicted, the plurality of raised areas 58 and/or plurality of recessed areas 60 can be MD-oriented relative to the movement of the core A through the rewinder 1.

The raised areas 58 can each be provided by at least one respective pressure-sensitive valve 50. However, one of skill in the art could provide any number of raised areas 58 with any number of pressure-sensitive valves 50 that provide the desired amount of glue, adhesive, and/or other fluid upon a core A that is provided in contacting and pressured engagement thereto. In any regard, a core A presented in contacting engagement with introductory portion 14B can be facilitated in obtaining rotational motion through the introductory portion 14B and have glue disposed at a location (pre-determined or otherwise) upon its surface upon contacting engagement with the respective pressure-sensitive valves 50 disposed upon any number of the raised areas 58 disposed upon the surface 15B.

Additionally, any number of the recessed areas 60 can facilitate removal of any excess glue, adhesive, and/or fluid that is not placed in contacting engagement with the surface of a core A. For example, any excess glue, adhesive, and/or fluid that does not remain in contacting engagement with a core A can 'overflow' into an adjacent recessed area 60 and be re-directed away from any downstream manufacturing equipment comprising rewinder 1 (such as first winding roller 3, second winding roller 5, third winding roller 7, concave cradle 41, winding cradle 13, and/or leading edge device). One of skill in the art could even provide glue, adhesive, and/or fluid reclamation equipment and/or systems in fluid engagement with any number of recessed areas 60. For example, each recessed area 60 can be operatively connected to a glue, adhesive, and/or fluid removal channel (not shown) that redirects any excess glue, adhesive, and/or fluid away from introductory portion 14B. Alternatively, each recessed area can be operatively connected to a glue, adhesive, and/or fluid removal reservoir (not shown) that collects any excess glue, adhesive, and/or fluid that has been redirected away from introductory portion 14B.

Figure 15:
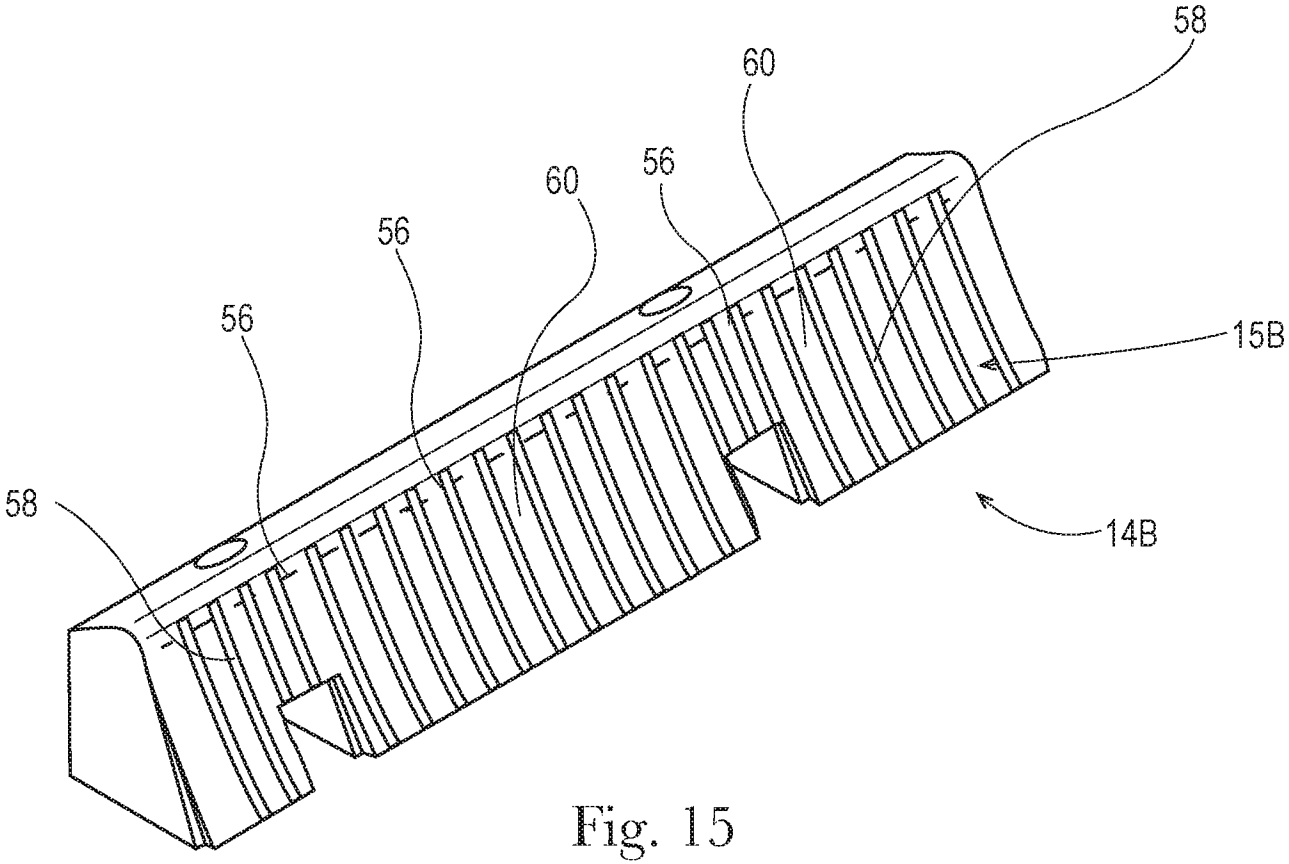
FIG. 15 is a perspective view of yet another exemplary introductory portion for a surface rewinding machine having both openings disposed within raised areas disposed upon the surface and recessed areas disposed within the surface thereof.

Alternatively, as shown in FIG. 15, the raised areas 58 can each be provided with a corresponding at least one respective opening 56. However, one of skill in the art could provide any number of raised areas 58 with any number of openings 56 that provide the desired amount of glue, adhesive, and/or other fluid at any desired flow rate, pressure, and the like upon a core A that is provided in contacting and pressured engagement thereto. In any regard, a core A presented in contacting engagement with introductory portion 14B can be facilitated in obtaining rotational motion through the introductory portion 14B and have glue disposed at a location (pre-determined or otherwise) thereon upon contacting engagement with a respective opening 56 disposed within any number of the raised areas 58 disposed upon the surface 15B.

Further, any number of the recessed areas 60 disposed upon the surface 15B can assist with and/or facilitate removal of any excess glue, adhesive, and/or fluid that is not in contacting engagement with a core A. For example, any excess glue, adhesive, and/or fluid that is not disposed into contacting engagement with the surface of a core A can overflow into a recess 60 and be re-directed away from any contact with any downstream manufacturing equipment comprising rewinder 1. One of skill in the art could even provide glue, adhesive, and/or fluid reclamation equipment and/or systems in fluid engagement with any number of recessed areas 60 upon the surface 15B. For example, each recessed area 60 can be operatively connected to a glue, adhesive, and/or fluid removal channel (not shown) that redirects any excess glue, adhesive, and/or fluid that is not provided in contacting engagement with the surface of a winding core A away from the surface 15B and introductory portion 14B. Further, each recessed area 60 can be operatively connected to a glue, adhesive, and/or fluid removal reservoir (not shown) that collects any excess glue, adhesive, and/or fluid that has been redirected away from the surface 15B and introductory portion 14B.

Figure 16:
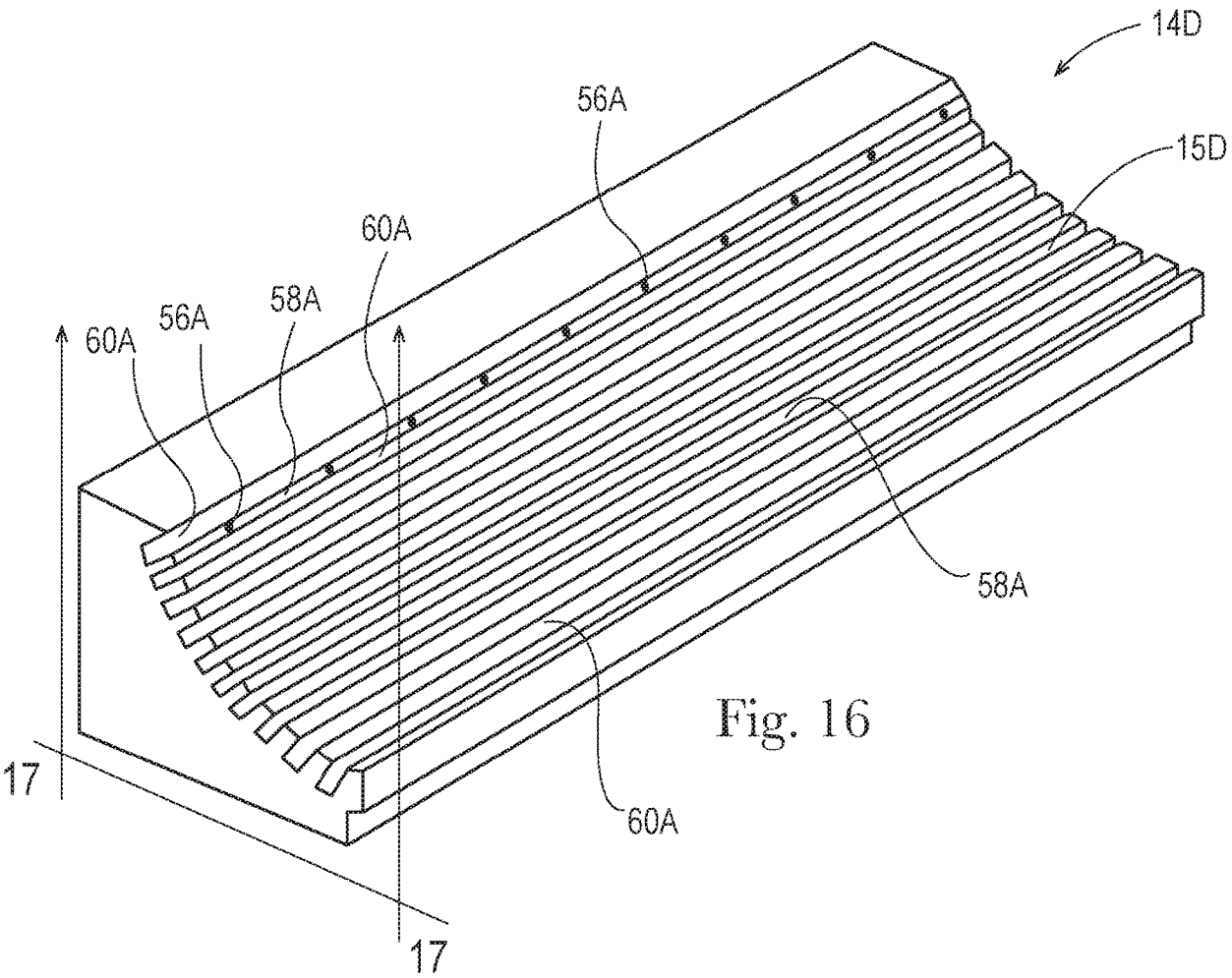
FIG. 16 is a perspective view of still another exemplary introductory portion for a surface rewinding machine having both opening disposed within longitudinally oriented raised areas disposed upon the surface and longitudinally oriented recessed areas disposed within the surface thereof.
Figure 17:
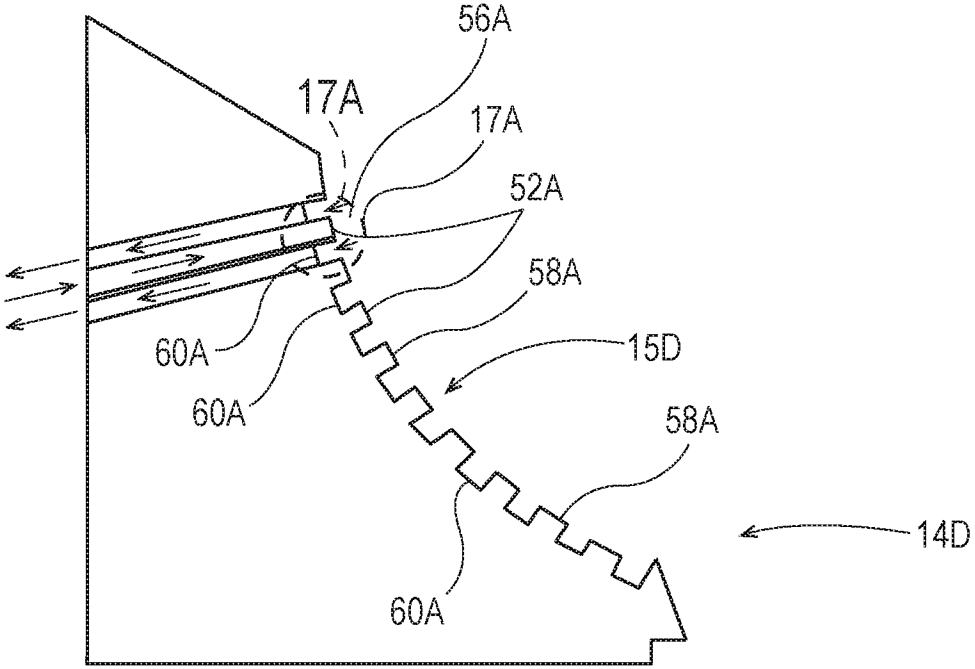
FIG. 17 is a cross-sectional view of the exemplary introductory portion of FIG. 16 taken at 17-17; and, FIG. 17A is a view of the region labeled 17A of FIG. 17.
Figure 17A:
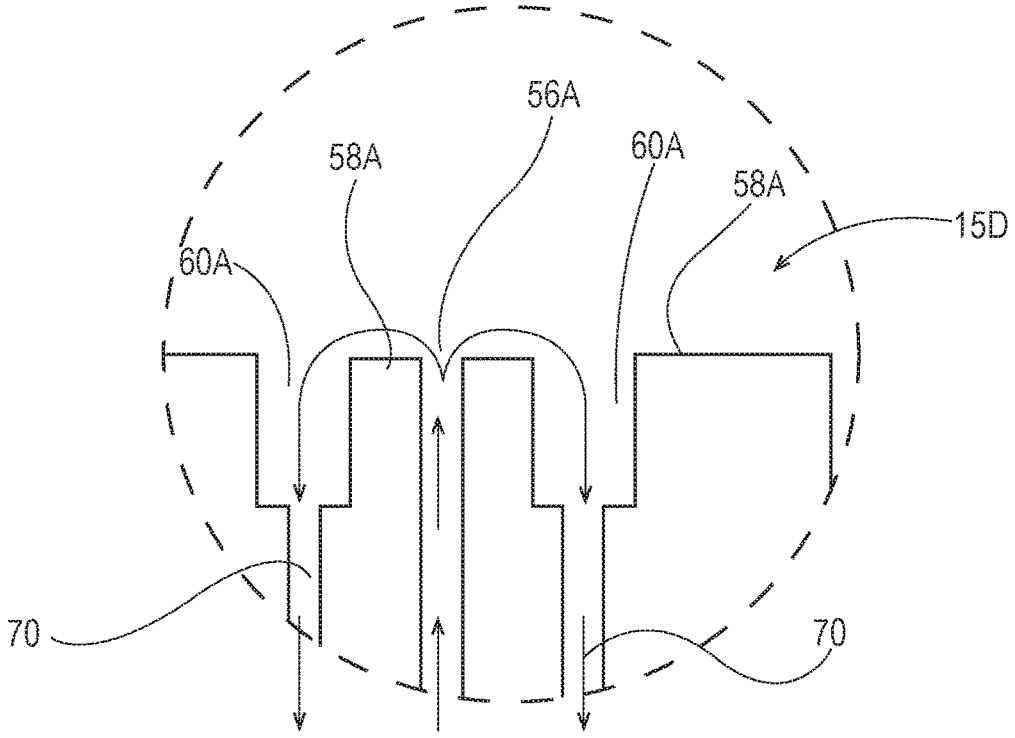

As shown in FIGS. 16-17 and 17A, the raised areas 58A of exemplary introductory portion 14D disposed upon the surface 15D can be disposed generally parallel or parallel to the longitudinal axis of introductory portion 14D (generally extending in the CD). As shown, at least one raised area 58A can be provided by at least one respective opening 56A or a plurality of openings 56A. However, one of skill in the art could provide any number of raised areas A that provide the desired amount of glue, adhesive, and/or other fluid upon the surface of a core A that is provided in contacting and pressured engagement thereto. In any regard, a core A presented in contacting engagement with introductory portion 14D can be facilitated in obtaining rotational motion through the introductory portion 14D and have glue, adhesive, and/or other fluid disposed at a location (pre-determined or otherwise) thereon upon fluidly contacting engagement with a respective opening 56A disposed within (or upon) any number of the raised areas 58A disposed upon the surface 15D of introductory portion 14D.

Further, any number of the recessed areas 60A can facilitate removal of any excess glue, adhesive, and/or fluid that is not placed in contacting engagement with a respective core A. For example, any excess glue, adhesive, and/or fluid that is not placed in contacting engagement with a core A can overflow into a recess 60A and be re-directed away from any downstream manufacturing equipment comprising rewinder 1. One of skill in the art could even provide glue, adhesive, and/or fluid reclamation equipment and/or systems in fluid engagement with any number of recessed areas 60A. For example, each recessed area can be operatively connected to a glue, adhesive, and/or fluid removal channel 70 that redirects any excess glue, adhesive, and/or fluid away from the surface 15D of introductory portion 14D. Alternatively, each recessed area can be operative connected to a glue, adhesive, and/or fluid removal reservoir (not shown) with or without the use of fluid removal channel 70 that collects any excess glue, adhesive, and/or fluid that has been redirected away from the surface 15D of introductory portion 14D.

EXAMPLES a. An improvement to a surface winder for winding a web material around a core having a radius, R, to obtain a log, the surface winder comprising a glue applicator for dispensing glue onto said core, a core inserter for transporting and inserting said core provided with said glue disposed thereon into a winding cradle defined at a top by an upper winding roller, supplied from above with said web material directed towards said winding cradle at a velocity, v, and at a bottom by a concave cradle associated downstream to a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said winding cradle in order to wind said web material around said core to obtain said log, said concave cradle comprising a leading edge device, said upper winding roller, said concave cradle, and said leading edge device forming an introductory portion, the improvement comprising:

wherein said leading edge device comprises a surface, said surface having at least one channel disposed therein, said at least one channel having a single entry point and a single exit point and extending from a position external to said leading edge and a first location disposed upon said surface, said first location disposed upon said surface being capable of receiving a fluid from said at least one channel, said fluid being fluidically displaced onto said core from said at least one channel when said core is in contacting engagement with said first location disposed upon said surface.

b. The improvement to a surface winder of a. wherein said surface further comprises a pressure-sensitive valve disposed thereon, said pressure-sensitive valve being in fluid communication with said at least one channel at said first location disposed upon said surface, said pressure-sensitive valve providing fluid communication of said first fluid from said channel to said core when said core is in contacting engagement therewith.

c. The improvement to a surface winder of any of a. through b. wherein said surface further comprises an opening disposed thereon at said first location disposed upon said surface, said opening being in fluid communication with said at least one channel at said first location disposed upon said surface, said opening providing fluid communication of said first fluid from said channel to said core when said core is in contacting engagement therewith.

d. The improvement to a surface winder of any of a. through c. wherein said surface causes said core to rotate at an angular velocity, $\omega$, wherein $v=R\omega$.

e. The improvement to a surface winder of any of a. through d. wherein said surface further comprises a texture comprising a plurality of protuberances disposed upon said surface of said leading edge device, said core contacting said protuberances when disposed between said leading edge device and said web material in contacting engagement with said upper winding roller.

f. The improvement to a surface winder of e. wherein each protuberance of said plurality of protuberances disposed upon said surface of said leading edge device are provided with a geometry, said geometry of each of said protuberances reducing slippage between said core and said surface.

g. The improvement to a surface winder of any of a. through f. wherein said surface comprises at least one recess disposed therein.

h. The improvement to a surface winder of g. wherein said recess is operatively connected to a second at least one channel, said second at least one channel having a single entry point and a single exit point and extending from a position external to said leading edge device and said recess, said second at least one channel being capable of receiving at least a portion of said first fluid from said recess, said at least a portion of said first fluid being fluidically displaceable through said second at least one channel to a position external to said leading edge device from said recess.

i. The improvement to a surface winder of any of a. through h. wherein said surface further comprises a raised area, said at least one channel extending from a position external to said leading edge device and said raised area.

j. The improvement to a surface winder of any of a. through i. wherein said surface further comprises at least a second channel disposed therein, said second channel having a single entry point and a single exit point and extending from a position external to said leading edge device and a second location disposed upon said surface, said surface being capable of receiving said fluid from said second channel at said second location disposed upon said surface, said fluid being fluidically displaced onto said core from said second channel when said core is in contacting engagement with said surface.

k. The improvement to a surface winder of any of a. through j. wherein said surface winder rotates said core about a longitudinal axis within said introductory portion such that said core contacts said web material and said surface winder causes said web material to adhesively bond said web material to said core after said fluid is fluidically displaced onto said core from said at least one channel when said core is in contacting engagement with said first location disposed upon said surface.

l. The improvement to a surface winder of k. wherein said surface winder rotates said core about said longitudinal axis after said web material is adhesively bonded onto said core to convolutely wind said web material about said core.

m. A leading edge device for a surface winder, said leading edge device comprising a surface, said leading edge device having at least one channel disposed therein, said at least one channel having a single entry point and a single exit point and extending from a position external to said leading edge device and a first location disposed upon said surface, said first location disposed upon said surface being capable of receiving a fluid from said at least one channel, said fluid being fluidically displaced onto a core from said at least one channel when said core is in contacting engagement with said first location disposed upon said surface.

n. The leading edge device of m. wherein said surface further comprises a pressure-sensitive valve disposed thereon, said pressure-sensitive valve being in fluid communication with said at least one channel at said first location disposed upon said surface, said pressure-sensitive valve providing fluid communication of said first fluid from said channel to said core when said core is in contacting engagement therewith.

o. The leading edge device of any of m. through n. wherein said surface further comprises a plurality of pressure-sensitive valves disposed thereon, each of said plurality of pressure-sensitive valves providing fluid communication of said first fluid to said core when said core is in contacting engagement with each of said plurality of pressure-sensitive valves.

p. The leading edge device of any of m. through o. wherein said leading edge device has a longitudinal axis, each of said plurality of pressure-sensitive valves being disposed adjacent each other relative to said longitudinal axis.

q. The leading edge device of any of m. through p. wherein surface further comprises a plurality of pressure-sensitive valves disposed thereon, each of said plurality of pressure-sensitive valves providing fluid communication of said first fluid to said core when said core is in contacting engagement with each of said plurality of pressure-sensitive valves.

r. The leading edge device of any of m. through q. wherein said surface further comprises an opening disposed thereon at said first location disposed upon said surface, said opening being in fluid communication with said at least one channel at said first location disposed upon said surface, said opening providing fluid communication of said first fluid from said channel to said core when said core is in contacting engagement therewith.

s. The leading edge device of r. wherein said surface further comprises a plurality of openings disposed thereon, each of said plurality of openings providing fluid communication of said first fluid to said core when said core is in contacting engagement with each of said plurality of openings.

t. The leading edge device of s. wherein said leading edge device has a longitudinal axis, each of said plurality of openings being disposed adjacent each other relative to said longitudinal axis.

u. The leading edge device of any of m. through u. wherein said surface comprises a texture comprising a plurality of protuberances disposed upon said surface, said core contacting said protuberances when disposed between said leading edge device and said web material in contacting engagement with said upper winding roller.

v. The leading edge device of any of m. through u. wherein said texture causes said core to rotate at an angular velocity, ω, wherein v=Rω.

w. The leading edge device of any of m. through v. wherein each protuberance of said plurality of protuberances disposed upon said surface of said leading edge device are provided with a geometry, said geometry of each of said protuberances reducing slippage between said core and said surface.

x. The leading edge device of any of m. through w. wherein said surface comprises at least one recess disposed therein.

y. The leading edge device of x. wherein said recess is operatively connected to a second at least one channel, said second at least one channel having a single entry point and a single exit point and extending from a position external to said leading edge device and said recess, said second at least one channel being capable of receiving at least a portion of said first fluid from said recess, said at least a portion of said first fluid being fluidically displaceable through said second at least one channel to a position external to said leading edge device from said recess.

z. The leading edge device of any of m. through z. wherein said surface further comprises a raised area, said at least one channel extending from a position external to said leading edge device and said raised area.

aa. The leading edge device of any of m. through aa. wherein said surface further comprises at least a second channel disposed therein, said second channel having a single entry point and a single exit point and extending from a position external to said leading edge device and a second location disposed upon said surface, said surface being capable of receiving said fluid from said second channel at said second location disposed upon said surface, said fluid being fluidically displaced onto said core from said second channel when said core is in contacting engagement with said surface.

bb. The leading edge device of any of m. through aa. wherein said leading edge device is operatively engageable with a concave cradle, said concave cradle being operatively associated with said surface winder.

cc. The leading edge device of bb. wherein said concave cradle and said introductory portion operatively engaged thereto are positioned in spaced relationship relative to an upper winding roll of said surface winder to form an introductory portion, said core being disposable in said introductory portion and in contacting engagement with said surface, said fluid being fluidically displaced onto said core from said at least one channel.

dd. The leading edge device of cc. wherein said surface causes said core to rotate at an angular velocity, ω, wherein v=Rω.

ee. The leading edge device of Claim dd. wherein said fluid is fluidically displaced onto said core from said at least one channel at a position relative to a perforation disposed within a web material in contacting engagement with said upper winding roll.

ff. The leading edge device of Claim dd. wherein said surface comprises a texture comprising a plurality of protuberances disposed upon said surface, said core contacting said protuberances when disposed between said leading edge device and said web material in contacting engagement with said upper winding roller.

Any dimensions and/or values disclosed herein are not to be understood as being strictly limited to the exact dimensions and/or numerical values recited. Instead, unless otherwise specified, each such dimension and/or value is intended to mean both the recited dimension and/or value and a functionally equivalent range surrounding that dimension or value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A leading edge device for a surface winder, said leading edge device comprising a surface, said leading edge device having at least one channel disposed therein, said at least one channel having a single entry point and a single exit point and extending from a position external to said leading edge device and a first location disposed upon said surface, said first location disposed upon said surface being capable of receiving a fluid from said at least one channel, said fluid being fluidically displaced onto a core from said at least one channel when said core is in contacting engagement with said first location disposed upon said surface.

2. The leading edge device of claim 1 wherein said surface further comprises a pressure-sensitive valve disposed thereon, said pressure-sensitive valve being in fluid communication with said at least one channel at said first location disposed upon said surface, said pressure-sensitive valve providing fluid communication of said first fluid from said channel to said core when said core is in contacting engagement therewith.

3. The leading edge device of claim 2 wherein said surface further comprises a plurality of pressure-sensitive valves disposed thereon, each of said plurality of pressure-sensitive valves providing fluid communication of said first fluid to said core when said core is in contacting engagement with each of said plurality of pressure-sensitive valves.

4. The leading edge device of claim 3 wherein said leading edge device has a longitudinal axis, each of said plurality of pressure-sensitive valves being disposed adjacent each other relative to said longitudinal axis.

5. The leading edge device of claim 1 wherein said surface further comprises a plurality of pressure-sensitive valves disposed thereon, each of said plurality of pressure-sensitive valves providing fluid communication of said first fluid to said core when said core is in contacting engagement with each of said plurality of pressure-sensitive valves.

6. The leading edge device of claim 1 wherein said surface further comprises an opening disposed thereon at said first location disposed upon said surface, said opening being in fluid communication with said at least one channel at said first location disposed upon said surface, said opening providing fluid communication of said first fluid from said channel to said core when said core is in contacting engagement therewith.

7. The leading edge device of claim 6 wherein said surface further comprises a plurality of openings disposed thereon, each of said plurality of openings providing fluid communication of said first fluid to said core when said core is in contacting engagement with each of said plurality of openings.

8. The leading edge device of claim 7 wherein said leading edge device has a longitudinal axis, each of said plurality of openings being disposed adjacent each other relative to said longitudinal axis.

9. The leading edge device of claim 1 wherein said surface comprises a texture comprising a plurality of protuberances disposed upon said surface, said core contacting said protuberances when disposed between said leading edge device and said web material in contacting engagement with said upper winding roller.

10. The leading edge device of claim 9 wherein each protuberance of said plurality of protuberances disposed upon said surface of said leading edge device are provided with a geometry, said geometry of each of said protuberances reducing slippage between said core and said surface.

11. The leading edge device of claim 1 wherein said texture causes said core to rotate at an angular velocity, $\omega$, wherein $v=R\omega$.

12. The leading edge device of claim 1 wherein said surface comprises at least one recess disposed therein.

13. The leading edge device of claim 12 wherein said recess is operatively connected to a second at least one channel, said second at least one channel having a single entry point and a single exit point and extending from a position external to said leading edge device and said recess, said second at least one channel being capable of receiving at least a portion of said first fluid from said recess, said at least a portion of said first fluid being fluidically displaceable through said second at least one channel to a position external to said leading edge device from said recess.

14. The leading edge device of claim 1 wherein said surface further comprises a raised area, said at least one channel extending from a position external to said leading edge device and said raised area.

15. The leading edge device of claim 1 wherein said surface further comprises at least a second channel disposed therein, said second channel having a single entry point and a single exit point and extending from a position external to said leading edge device and a second location disposed upon said surface, said surface being capable of receiving said fluid from said second channel at said second location disposed upon said surface, said fluid being fluidically displaced onto said core from said second channel when said core is in contacting engagement with said surface.

16. The leading edge device of claim 1 wherein said leading edge device is operatively engageable with a concave cradle, said concave cradle being operatively associated with said surface winder.

17. The leading edge device of claim 16 wherein said concave cradle and said introductory portion operatively engaged thereto are positioned in spaced relationship relative to an upper winding roll of said surface winder to form an introductory portion, said core being disposable in said introductory portion and in contacting engagement with said surface, said fluid being fluidically displaced onto said core from said at least one channel.

18. The leading edge device of claim 17 wherein said surface causes said core to rotate at an angular velocity, $\omega$, wherein $v=R\omega$.

19. The leading edge device of claim 18 wherein said fluid is fluidically displaced onto said core from said at least one channel at a position relative to a perforation disposed within a web material in contacting engagement with said upper winding roll.

20. The leading edge device of claim 18 wherein said surface comprises a texture comprising a plurality of protuberances disposed upon said surface, said core contacting said protuberances when disposed between said leading edge device and said web material in contacting engagement with said upper winding roller.

* * * * *